US010421596B2

(12) United States Patent
Koptis et al.

(10) Patent No.: US 10,421,596 B2
(45) Date of Patent: Sep. 24, 2019

(54) CONTAINER AND DISPENSER FOR FLOWABLE MATERIAL AND METHOD

(71) Applicants: Kurt Koptis, Joshua Tree, CA (US); Jeremy Robinson, Penn Valley, CA (US)

(72) Inventors: Kurt Koptis, Joshua Tree, CA (US); Jeremy Robinson, Penn Valley, CA (US)

( * ) Notice: Subject to any disclaimer, the term of this patent is extended or adjusted under 35 U.S.C. 154(b) by 23 days.

(21) Appl. No.: 15/115,506

(22) PCT Filed: Feb. 9, 2015

(86) PCT No.: PCT/US2015/014986
§ 371 (c)(1),
(2) Date: Jul. 29, 2016

(87) PCT Pub. No.: WO2015/120371
PCT Pub. Date: Aug. 13, 2015

(65) Prior Publication Data

US 2017/0008687 A1 Jan. 12, 2017

Related U.S. Application Data

(60) Provisional application No. 61/965,793, filed on Feb. 10, 2014.

(51) Int. Cl.
*B65D 81/32* (2006.01)
*B05C 17/005* (2006.01)
(Continued)

(52) U.S. Cl.
CPC ..... *B65D 81/325* (2013.01); *B01F 5/0647* (2013.01); *B01F 5/0651* (2013.01); *B01F 5/08* (2013.01); *B01F 13/0023* (2013.01); *B01F 15/0087* (2013.01); *B01F 15/0224* (2013.01); *B05C 17/00503* (2013.01); *B05C 17/00559* (2013.01); *B05C 17/00583* (2013.01); *B65D 25/465* (2013.01); *B65D 25/48* (2013.01); *B65D 47/42* (2013.01); *B65D 81/3255* (2013.01);
(Continued)

(58) Field of Classification Search
CPC ..... B65D 81/325; B65D 81/3238; B65D 81/3244; B65D 81/3272; B05C 17/00553; B05C 17/00559; B05C 17/0133
USPC ..... 401/164, 175
See application file for complete search history.

(56) References Cited

U.S. PATENT DOCUMENTS 4,150,904 A 4/1979 Stewart
4,884,703 A * 12/1989 O'Meara ..... B65D 81/3261 215/250
(Continued)

*Primary Examiner* — David P Angwin
*Assistant Examiner* — Bradley S Oliver
(74) *Attorney, Agent, or Firm* — Law Offices of David M. Lang; David M. Lang

(57) ABSTRACT

Varied embodiments of a container/dispenser having a multi-chamber bellows member having a plurality of collapsible bellows chambers allowing more than one substance to be contained within the container and simultaneously dispensed when a sufficient axial force is exerted on a platform to compress the bellows member forcing flowable materials from each chamber. In an alternative embodiment, the present invention discloses a retrofit multi-chambered bellows container, which may be adapted to a standard caulking tube container.

11 Claims, 27 Drawing Sheets

(51) Int. Cl.

| | |
|---|---|
| ***B65D 25/46*** | (2006.01) |
| ***B65D 83/00*** | (2006.01) |
| ***B65D 47/42*** | (2006.01) |
| ***B65D 25/48*** | (2006.01) |
| ***B01F 13/00*** | (2006.01) |
| ***B01F 15/00*** | (2006.01) |
| ***B01F 15/02*** | (2006.01) |
| ***B01F 5/06*** | (2006.01) |
| ***B01F 5/08*** | (2006.01) |

(52) U.S. Cl.
CPC ..... *B65D 81/3288* (2013.01); *B65D 83/0011* (2013.01)

(56) References Cited

U.S. PATENT DOCUMENTS

| | | | | |
|---|---|---|---|---|
| 5,244,120 | A | 9/1993 | O'Meara | |
| 5,386,928 | A * | 2/1995 | Blette | B05C 17/00516 222/136 |
| 5,462,208 | A | 10/1995 | Stahley et al. | |
| 6,129,472 | A * | 10/2000 | Thayer | A45D 40/04 222/137 |
| 6,454,129 | B1 * | 9/2002 | Green | B65D 81/325 222/105 |
| 2010/0155431 | A1 | 6/2010 | Bartolucci et al. | |

* cited by examiner

CONTAINER AND DISPENSER FOR FLOWABLE MATERIAL AND METHOD

CROSS-REFERENCE TO RELATED APPLICATIONS

This application is a national phase application of international patent application PCT/US2015/014986, filed Feb. 9, 2015, entitled CONTAINER AND DISPENSER FOR FLOWABLE MATERIAL AND METHOD which claims the benefit under 35 U.S.C. § 119(e), to U.S. Provisional Application U.S. 61/965,793, filed Feb. 10, 2014, entitled "TWIST CONTAINER-APPLICATION MEAN'S" which is incorporated by reference in its entirety and made part of this specification.

FIELD OF INVENTION

The present invention relates to dispensers generally, and more specifically to apparatus and methods permitting user actuated dispensing of flowable material from a dispenser serving as a both a container and applicator.

BACKGROUND

Typical dispensers used in caulking require a container with caulking, or similar materials, and a caulking gun. This presents may present problems for the causal user who may not have access to a caulking gun.

Further, several substances typical require the application of two substances to effect curing. Caulking tubes currently available contain a single substance.

SUMMARY

The present inventive embodiments are directed toward a container and dispenser for flowable material that, in a preferred embodiment, does not require a caulking gun. In an alternative embodiment, the present invention discloses a dual bellows container, or single bellows having a plurality of chambers, allowing more than one substance to be contained within the container and simultaneously dispensed. In an alternative embodiment, the present invention discloses a retrofit multi-chambered container, which may be adapted to a standard caulking tube container.

DETAILED DESCRIPTION

Figure 1:
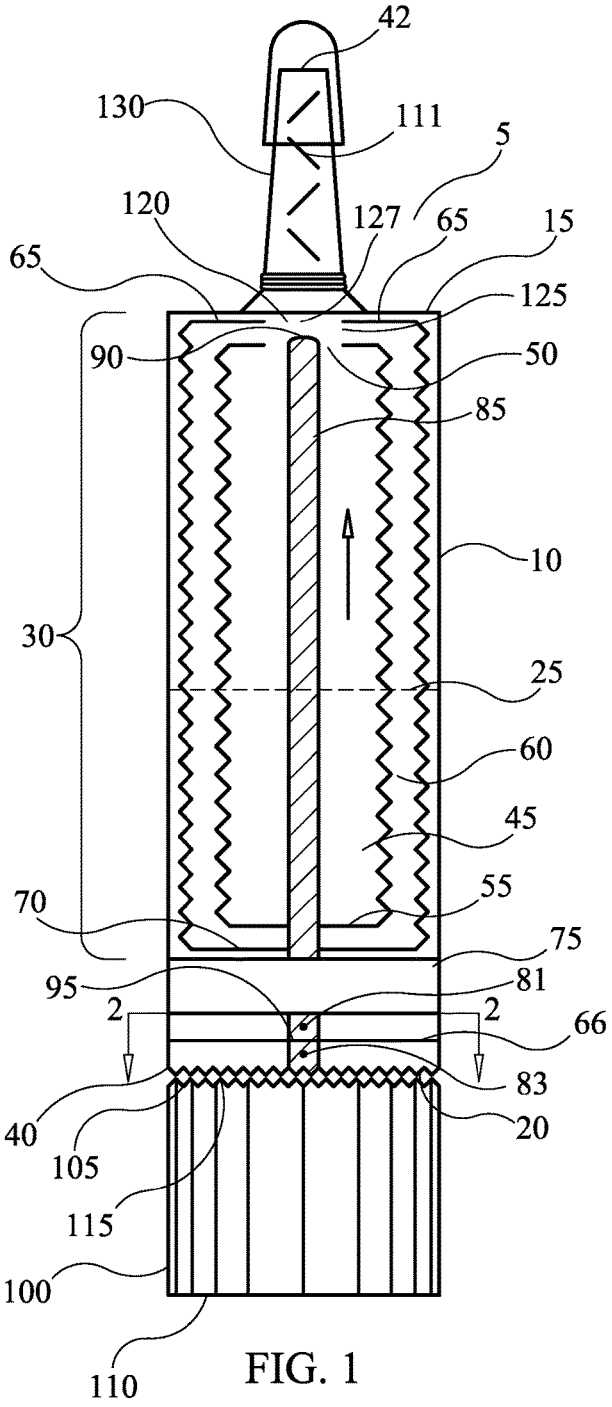
FIG. 1 is a schematic view of an embodiment container/dispenser.

Turning now to the drawings, FIG. 1, container/dispenser 5 has cylindrical container body 10 having a first end 15 and second end 20, wherein the container body 10 has a diameter and diametrical void 25, wherein said cylindrical container 10 has a long axis 30; wherein the second end 20 is shaped to define a container pattern 40. First end of container body 10 has an opening 42.

Figure 2:
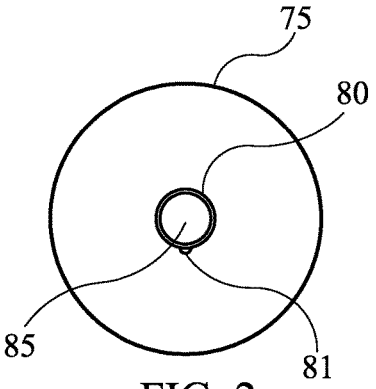
FIG. 2 is a cross-sectional view taken through line 2-2 of FIG. 1.

A collapsible first bellows container 45, disposed within the cylindrical container body 10, said first bellows 45 having a first end 50 and a second end 55, wherein said bellows has a volume, wherein said volume can be changed by compression, wherein a portion of said bellows first end 50 is open. A collapsible second bellows container 60, disposed within the cylindrical container body 10, said second bellows 60 having a first end 65 and a second end 70, wherein said bellows 60 has a volume, wherein said volume can be changed by compression, wherein a portion of said second bellows 60 first end is open;

A disc 75 shaped to define a threaded central aperture 80, best visualized by FIG. 2, wherein said disc 75 has a diameter, wherein the diameter of the disc is less than the cylindrical container's 10 diameter;

A threaded rod 85 having a first end 90 and second end 95, wherein threaded rod 85 is disposed within container body 10 and passes through threaded central aperture 80, wherein said disc 75 and said threaded rod 85 have a threadable mating engagement.

The relationship of threaded rod 85 to the bellows containers is variable. In one embodiment, threaded rod 85 passes through a void in the center of first bellows container 45 and second bellows container 60 and sealed sufficiently to prevent leaking of product. In another embodiment, first bellows container 45 and second bellows container 60 are shaped to define an aperture through which rod 85 passes.

In one embodiment, rod 85 passes through and is secured by rod stabilizing surface 66, and is rotatable within. In this embodiment, rod 85 has first projection 81 and second projection 83 above and below surface 66 respectively to maintain rod 85 within surface 66, between projections 81 and 83, and rotatable within.

Twistable handle 100, is affixed to threaded rod's 85 second end 95, wherein handle 100 has a first end 105 and second end 110, wherein said first end 105 is shaped to define a handle pattern 115, wherein said container pattern 40 and handle pattern 115 are mateable. A tape seal may be disposed between handle 100 and at least a portion of container 10 to prevent movement of handle 100 relative to container 10 before intended use.

In one embodiment the total container/dispenser 5 volume is about 10 ounces split between first bellows container 45 and second bellows container 60. Container body 10 is illustrated in FIG. 1 as cylindrical, but in an alternative embodiment, a container body may be cuboidal—or other shaped, provided the disc substantially occupies the cross-sectional area of that shape.

First bellows container 45 has a first end 50 with an opening that defines a first bellows egress point 120. Second bellows container 60 has a first end 65 with an opening that defines a second bellows egress point 125.

In one embodiment, first egress point 120 and second egress 125 point terminate at a common egress point 127. Materials expressed from first egress point 120 and second egress point 125 make first contact at common egress point 127.

In one embodiment, materials making contact at common egress point 127 continue to be mixed in a mixing tip 130. Mixing guides 111, direct flowable materials in alternating directions to facilitate intermixing materials from first bellows container 45 and second bellows container 60. In an alternative embodiment, mixing guides 111 are omitted. In an alternative embodiment, common egress point 127 is located directly within mixing tip 130.

In another alternative, material from first bellows container 45 and second bellows container 60 may remain distinct through use of a divider located at common opening within a common opening or a tip.

To use container/dispenser 5, a user removes tape seal. Next the user, pulls handle 100 backwardly and axially, in the direction of apparatus 5's long axis 30 away from first end 15. Rod 85 moves axially until contact between first projection 81 and stabilizing surface 66, at which point there is sufficient clearance between container pattern 40 and handle pattern 115 to permit handle 100 rotation. User rotates handle 100 which drives disc 75 upwardly, toward container's first end 15, in the direction of container 10's long axis 30. As disc 75 moves upwardly, it compresses first bellows container 45 and second bellows container 60. As first 45 and second 60 bellows containers are compressed, a sufficient force is created within first 45 and second 60 bellows containers to express flowable materials contained within, out of first egress point 120 and second egress point 125, through common egress point 127, and into mixing tip 130. Mixing is facilitated through mixing guides 111, within mixing tip 130 and mixed materials may be expressed from opening 42 of container/dispenser 5.

In an alternative embodiment, a multi-chambered integrally formed bellows member may be used instead of two distinct bellows containers. In this embodiment rod 85 may pass through the multi-chambered member, or the multi-chambered member may be shaped to define an aperture through which rod 85 passes.

Figure 3:
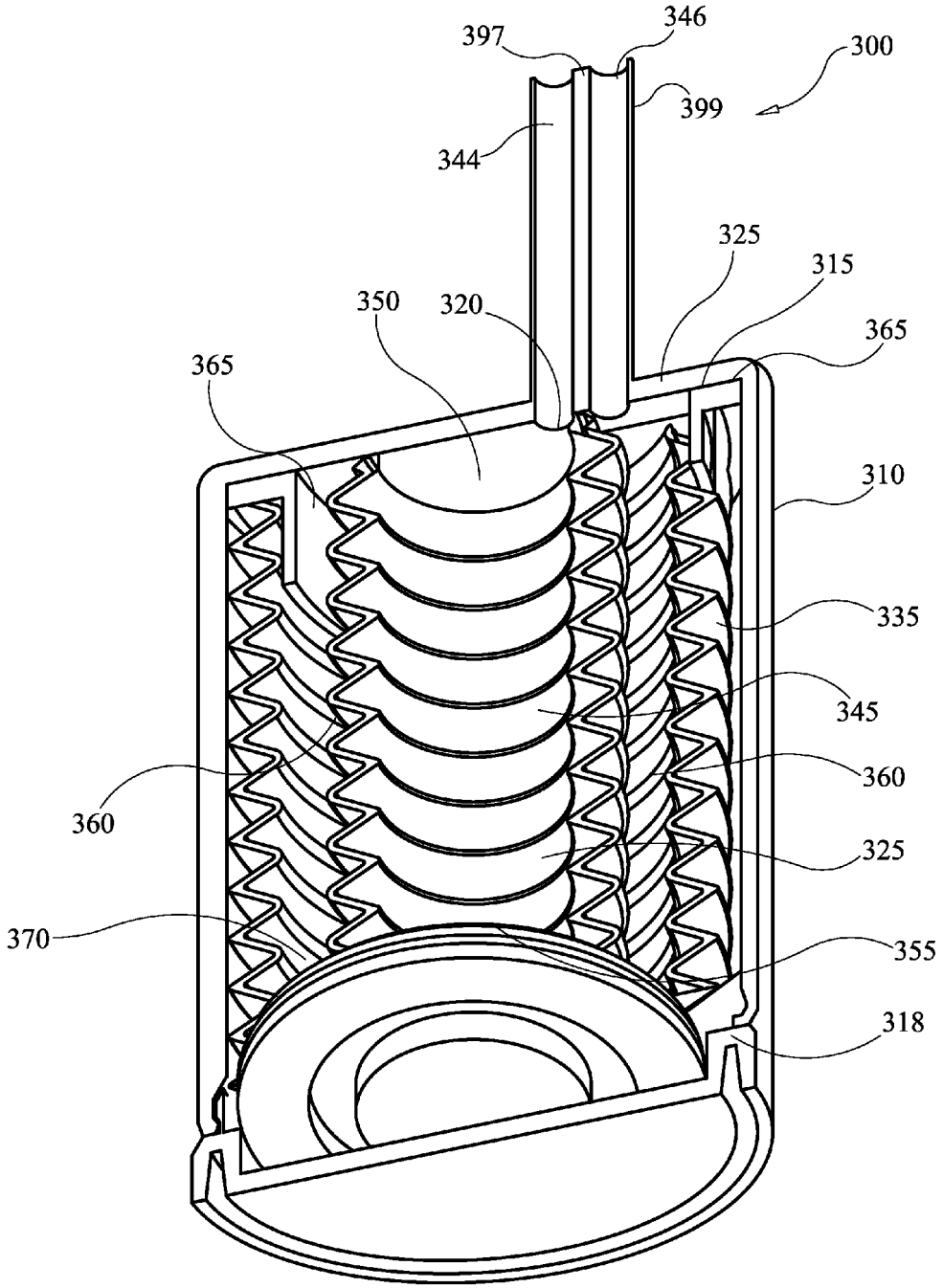
FIG. 3 is a sectional view of an embodiment container/dispenser.

FIG. 3 illustrates an alternative embodiment container/dispenser 300. A cylindrical container body 310 having a first end 315 and second end 318, wherein the container body 310 has a diameter and diametrical void 325, wherein said cylindrical container 310 has a long axis. First end of container body 310 has a first opening 344 and a second opening 346. Container body 310 is shaped to define threaded inner wall 335.

A multi-chambered bellows member 444 is disposed within container 345. The multi-chambered bellows member 444 is shaped to define a collapsible first bellows chamber 345. First bellows chamber 345 has a first end 350 and a second end 355, wherein said first bellows chamber 345 has a volume, wherein said volume can be changed by compression, wherein first bellows chamber 345 has an opening which defines a first chamber outflow tract 320 that communicates with first opening 344, such that flowable material within first bellows container 345 may be expressed from first bellows container 345 through first chamber outflow tract 320 into first opening 344 of applicator tip 399.

The multi-chambered bellows member 444 (FIG. 4) is shaped to define a collapsible second bellows chamber 360. Second bellows chamber 360 has a first end 365 and a second end 370, wherein said second bellows chamber 360 has a volume, wherein said volume can be changed by compression, wherein second bellows chamber 360 has an opening which defines a second chamber outflow tract 325 that communicates with second opening 346, such that flowable material within second bellows container 360 may be expressed from second bellows container 360 through second chamber outflow tract 325 into first opening 346 of applicator tip 399. Therefore, flowable material may be expressed from first bellows chamber 345 through outflow tract 320 and from second chamber 360 through second outflow tract 325. In the embodiment illustrated by FIG. 3, applicator tip 399 is divided by partition 397. In an alternative embodiment, partition 397 is omitted at flowable materials from first outflow tract 320 and second outflow tract 325 mix directly in a tip—such as applicator tip 6130 of FIG. 61.

Figure 4:
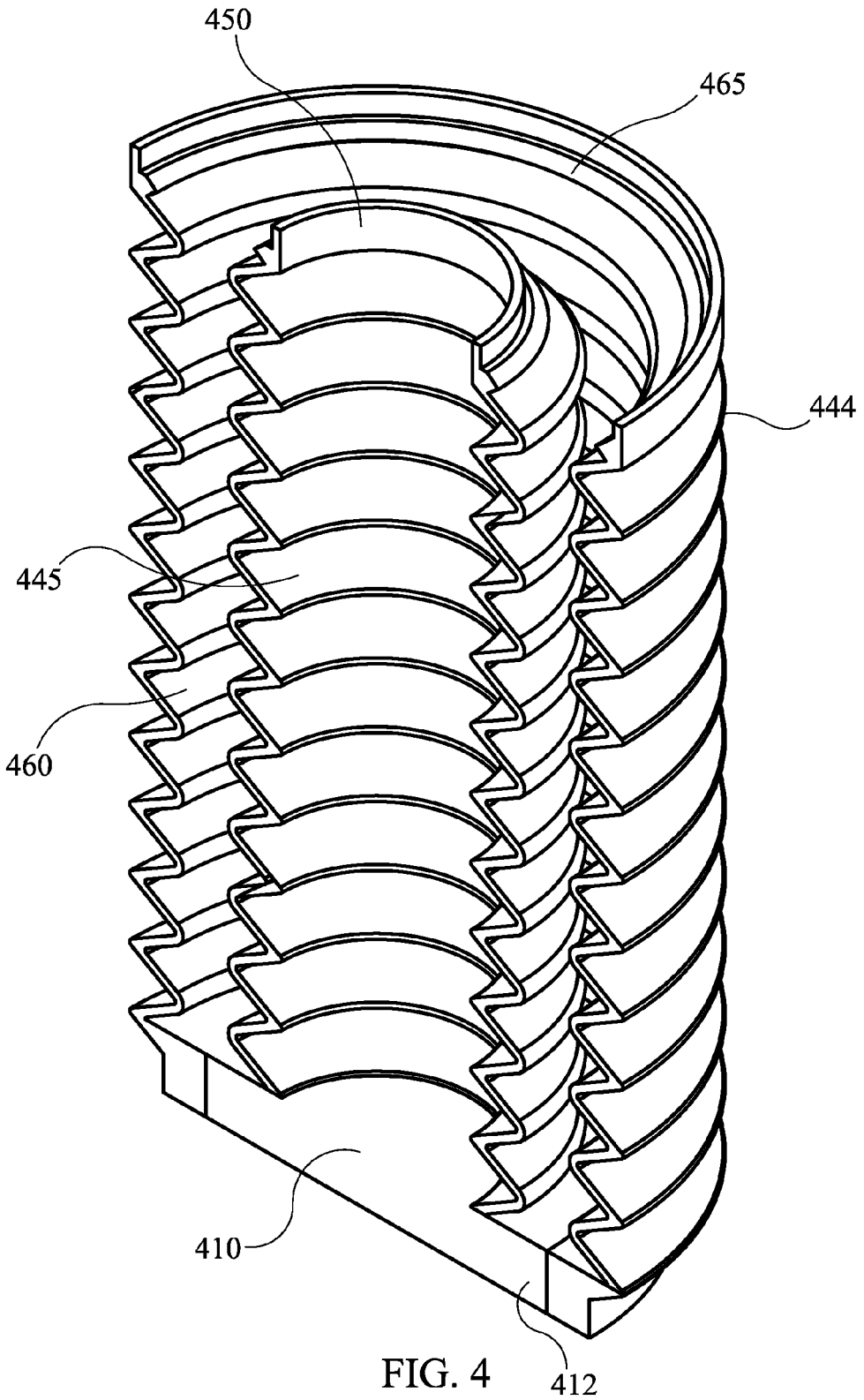
FIG. 4 is a sectional view of an embodiment multi-chambered bellows.

FIG. 4 is a perspective view of a cross-section an integrally molded, multi-chambered bellows member 444 demonstrating a plurality of chambers. First bellows chamber 445 with first bellows chamber top end 450, and second bellows chamber 460 with second bellows chamber top end 465. For convenience, the multi-chambered bellows member 444 illustrated by FIG. 4 is illustrated with two chambers—but it should be recognized that member 444 may be shaped to define a number of chambers. Further multi-chambered bellows member 444 may be used in a variety of embodiments disclosed herein. Use of distinct reference characters is for illustrative purposes only, and the illustrated embodiment or feature may be used either cooperatively with or distinctly from any other embodiment or feature unless specified otherwise. Platform 410 fits within the platform recess 412 of bellows member 444. Axial force directed on platform 410 in the direction of top end 450 and top end 465 compresses member 444 and both chambers within.

Figure 5:
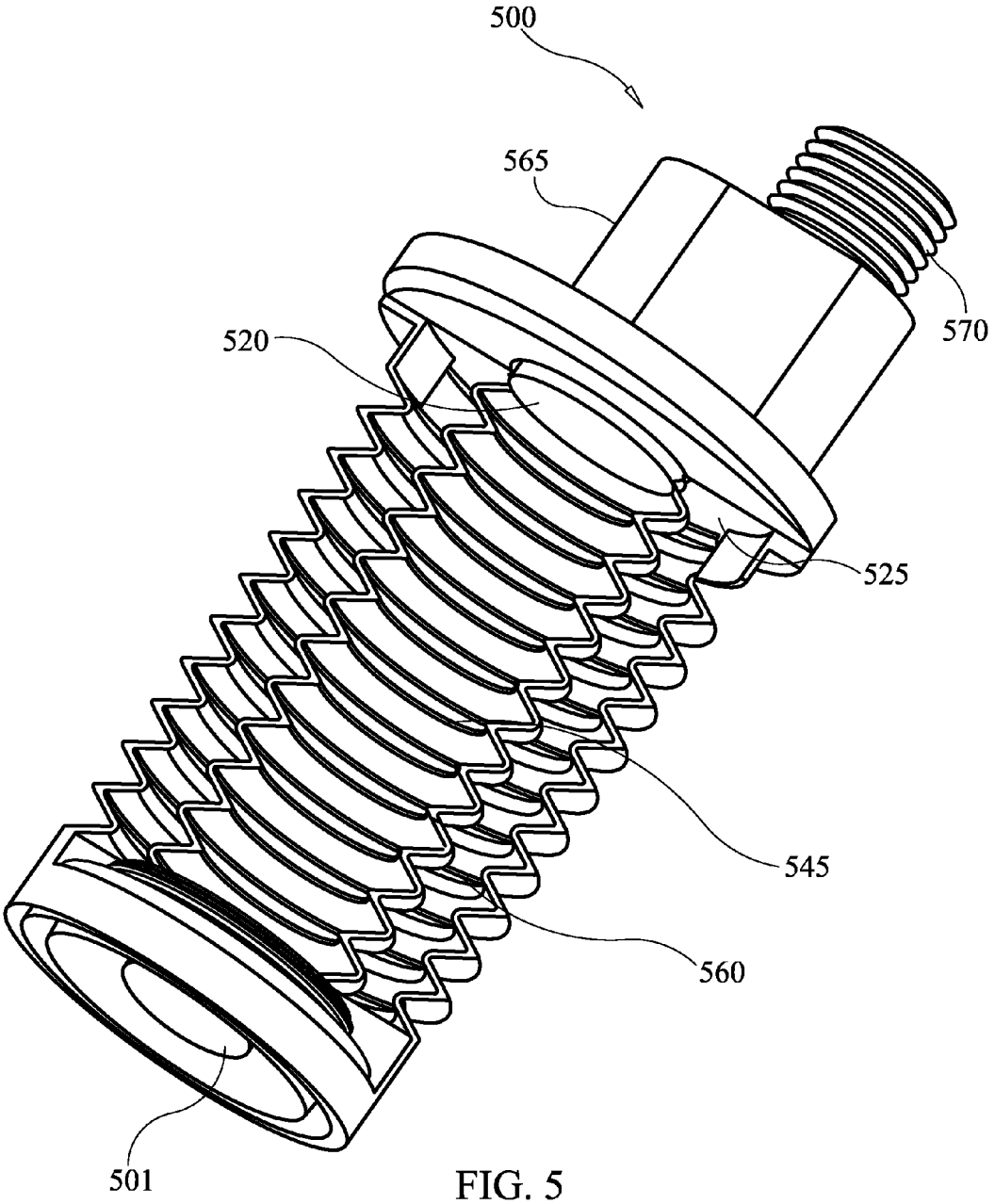
FIG. 5 is a perspective view of an embodiment container/dispenser.

FIG. 5 illustrates a perspective view of an embodiment container/dispenser 500. Disc 501 may be pushed by a user with a sufficient force to compress first bellows chamber 545 and second bellows chamber 560 sufficiently to express flowable material contained within first bellows chamber 545 through first bellows outflow tract 520 and material contained within second bellows chamber 560 through second bellows outflow tract 525. A mixing chamber 565 permits flowable substances expressed from first outflow tract 520 and second outflow tract 525 to mix. A coupling, for example threaded coupling 570, permits connection of a tip.

Figure 6:
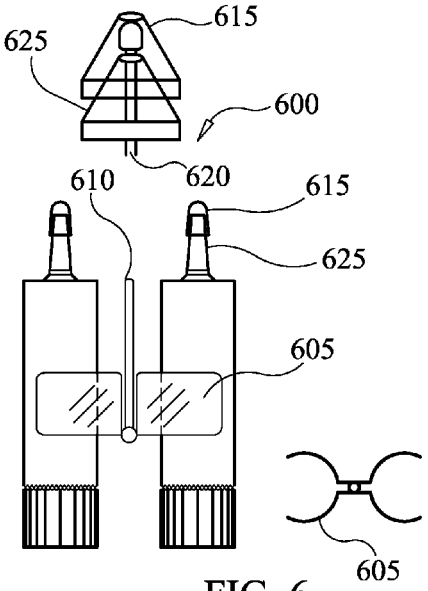
FIG. 6 is a side elevation view of an embodiment dual tube container/dispenser showing cap and clip.

FIG. 6 illustrates an embodiment pair of twist-up container/dispenser 600 having a snap holder 605 and mixing stick 610. A cover 615 has an affixed pin 620, may be disposed on tip 625. Snap holder 605 holds two container bodies 630 together.

Figure 7:
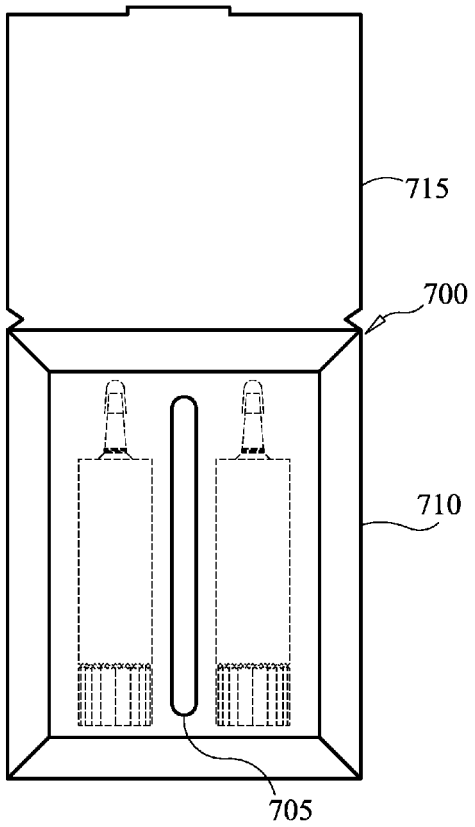
FIG. 7 is a top view of an embodiment container/dispenser packaging.

FIG. 7 illustrates an embodiment product packaging 700 having a divider 705 in the center of packaging housing 710. A fold-down cover 715 may be opaque or clear.

Figure 8:
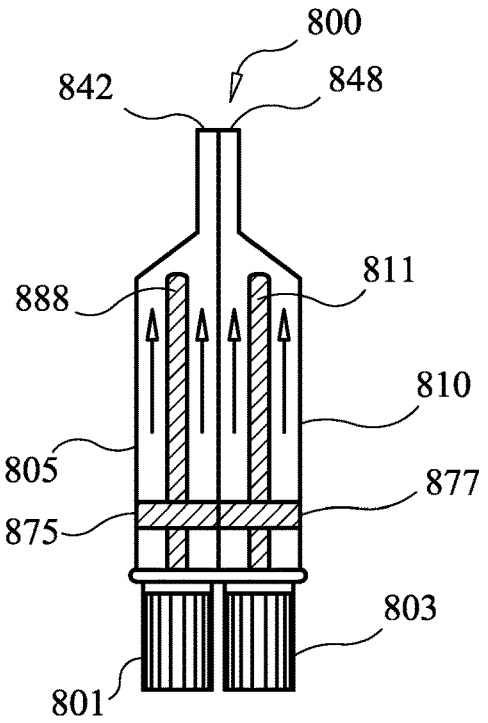
FIG. 8 is a perspective view of an embodiment single mold dual container/dispenser.

FIG. 8 illustrates an integrally molded, dual container/dispenser 800. A first container 805 is sealed and separate from a second container 810. A first container rotatable handle 801 rotates rod 888 and drives first disc 875; a second container rotatable handle 803 rotates second rod 811 and drives second disc 877. Materials from first container 805 flow through first container tip opening 842; materials from second container 810 flow through second container tip opening 848. Materials are mixed after leaving container 800. This embodiment may be used for adhesives—such as epoxy—requiring two flowable substances to cure.

Figure 9:
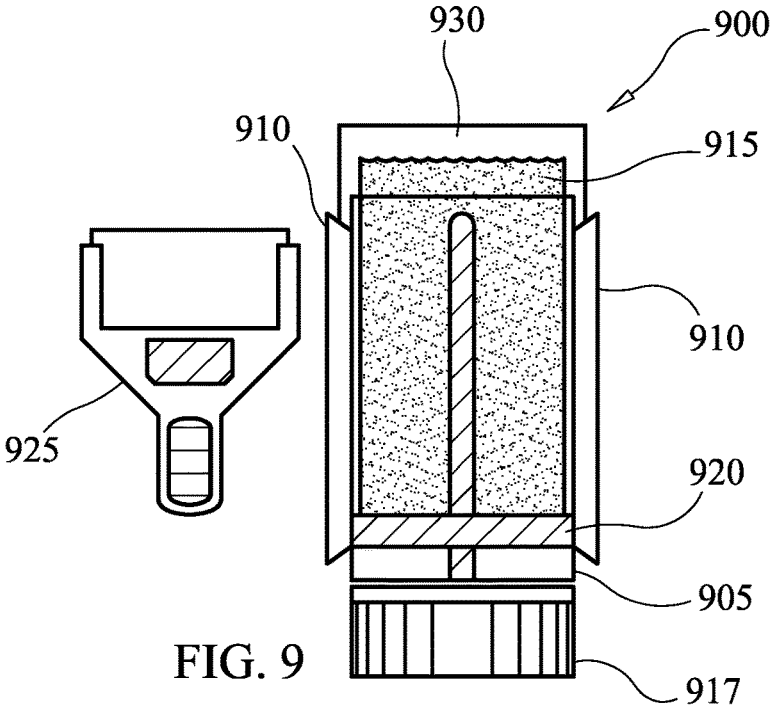
FIG. 9 is an embodiment food container/dispenser with a separate cutter illustrated.

The present invention has a variety of applications in different industries. In one embodiment container/dispenser, solid materials may be advanced from within container/dispenser. For example, FIG. 9 shows an embodiment twist-up food container/dispenser 900 which may be used to hold and dispense non-flowable solids, such as meats, cheeses, and other foods. Base 905 is supported by feet 910 located on either side of base 905 and may be rubberized at least in part, or have a rubberized pad affixed thereto to prevent slipping. An example food product 915 (such as cheese) may be advanced when user rotates handle 917 to advance platform 920 and food product 915. A handheld food slicer 925 may be used to cut food product 915 against cutting surface 930.

Figure 10:
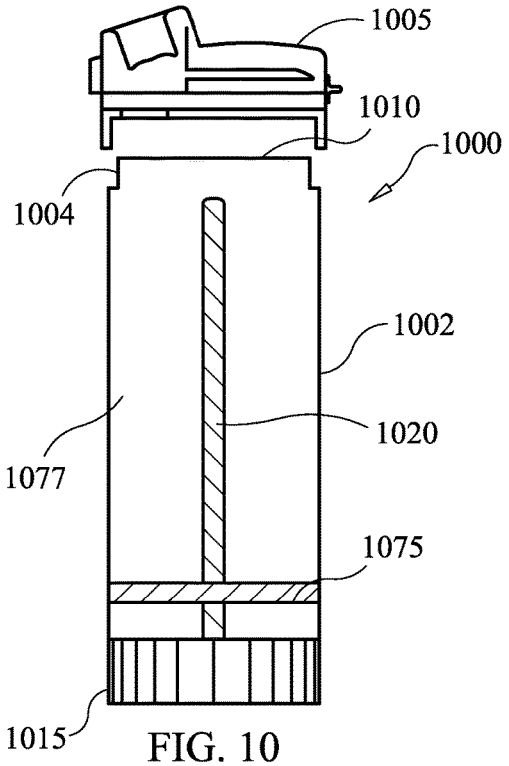
FIG. 10 illustrates an elevation view of a pet food container/dispenser.
Figure 11:
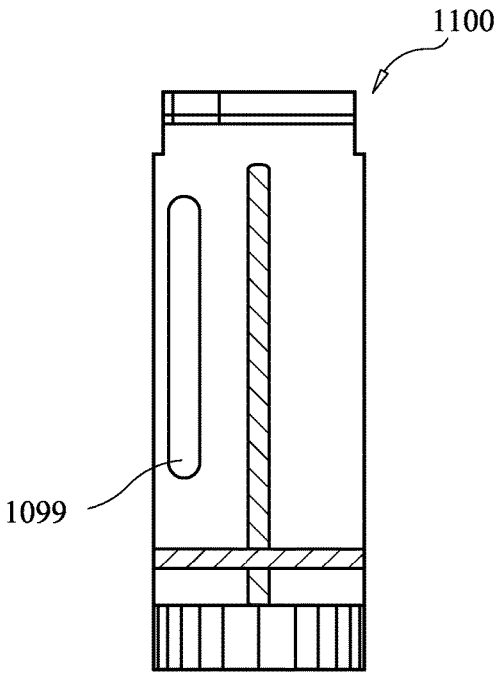
FIG. 11 is an elevation view of a container/dispenser having a level window.
Figure 12:
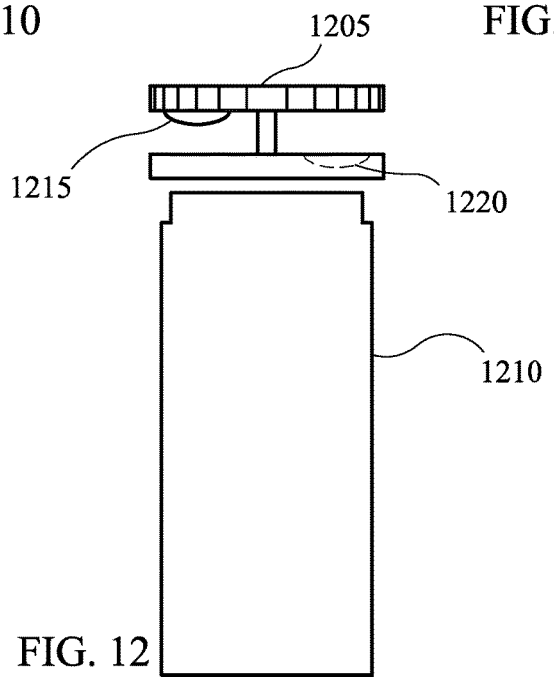
FIG. 12 is an elevation view of a container dispenser illustrating an embodiment cap.

FIG. 10 illustrates a pet food container/dispenser 1000 having a container body 1002. A flip top container cover assembly 1005, which may be hinged, may be snap-fitted at snap point 1004 to cover container's 1000 opening 1010. Product material is stored inside 1077 container body 1002. Rotatable handle 1015 is affixed to rod 1020 that drives disc 1075 along the long axis of container body 1002 toward opening 1010. FIG. 11 illustrates an optional window 1099 allowing a product level to be viewed from outside container 1100. FIG. 12 illustrates an alternative embodiment screw top having a twist-to-open cover 1205 and base 1210 that snaps into snap point 1004. Twist cover 1205 may be secured when projection 1215 registers with molded depression 1220—locking cap 1205 into place.

Figure 13:
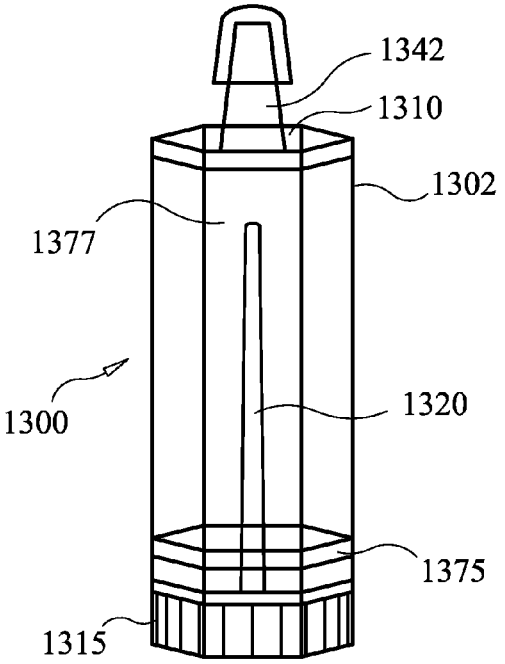
FIG. 13 is a schematic of an embodiment container/dispenser for high viscosity materials.

FIG. 13 illustrates an embodiment container/dispenser 1300 for thick materials such as soft butter, shortening, honey, and the like contained container/dispenser's 1300's inside volume 1377. Handle 1315 is affixed to rod 1320 and utilized a large mechanical advantage to slowly drive disc 1375 toward opening 1310 communicating with an oversized tip 1342 that allows thick materials to flow.

Figure 14:
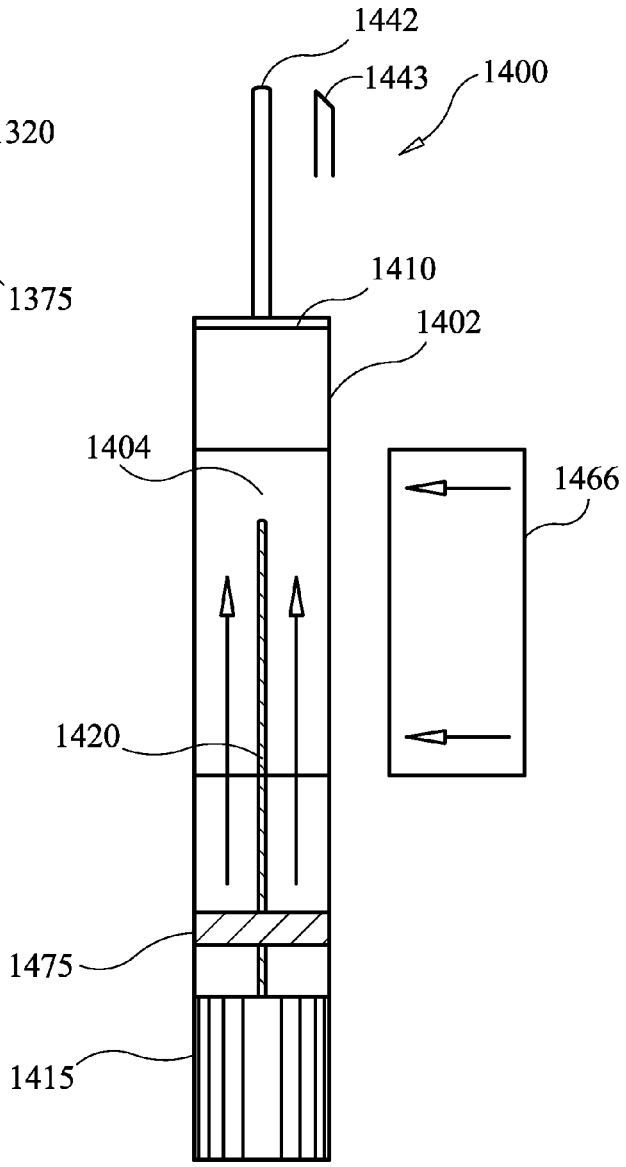
FIG. 14 is a schematic of an embodiment container/dispenser featuring a removable window.

FIG. 14 illustrates an embodiment container/dispenser 1400 which may be used for foodstuff. Container body 1402 has an opening 1404 to access the inside of container body 1402. Opening cover window 1466 slides over opening 1404 to seal container body 1402. Rotatable handle 1415 is affixed to rod 1420 and rotation of handle 1415 drives disc 1475 upwardly toward container first end 1410. Material contained within container 1402 may be expressed through non-beveled tip 1442 or alternatively through beveled tip 1443. In one embodiment, tips 1442 and 1443 are sharp and may penetrate a solid surface, such as meat. This permits flowable food items to be introduced into a specific solid substance. In use, this embodiment could be used to provide the deposition of flowable foods, spices, and the like to a specific region of a food product—such as a slab of meat.

Figure 15:
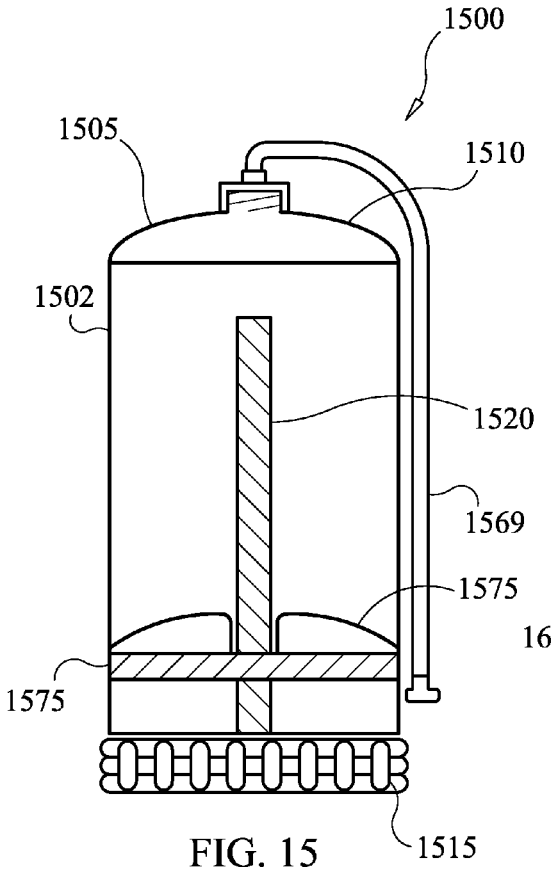
FIG. 15 is a schematic of an embodiment illustrates an embodiment dome shaped container/dispenser.

FIG. 15 illustrates a dome shaped container/dispenser 1500. Container body 1502 is shaped to define a domed top 1505. A rotatable handle 1515 is affixed to rod 1520 and a domed-shaped platform 1575 having a central threaded aperture is disposed on rod 1520. Platform 1575 is sealed against the inner wall of container body 1502. Hose 1569 is in communication with the interior of container body 1502 above dome 1575. When fully raised, platform 1575 completely occupies the domed top 1505, and the substantial volume of any solid, liquid, or gas contained within container 1502 is expressed out through hose 1569. This embodiment could be utilized to contain and dispense emergency tire repair products.

Figure 16:
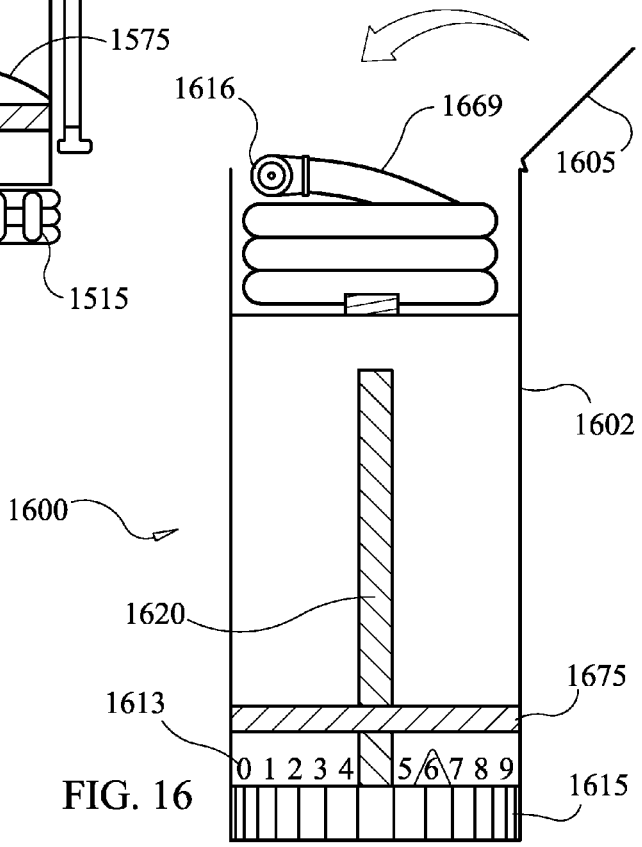
FIG. 16 is a schematic of an embodiment dome shaped container/dispenser.

FIG. 16 illustrates a twist-up container/dispenser 1600 for grease or oil products. Handle 1616 is affixed to rod 1620. Printed numerical indicia 1613 are printed on the surface of container body 1602. Hose 1669 is in communication with the interior or container body 1602. Hose 1669 may be stored within storage compartment 1616, and cover 1605 can close maintaining hose 1669 within.

Figure 17:
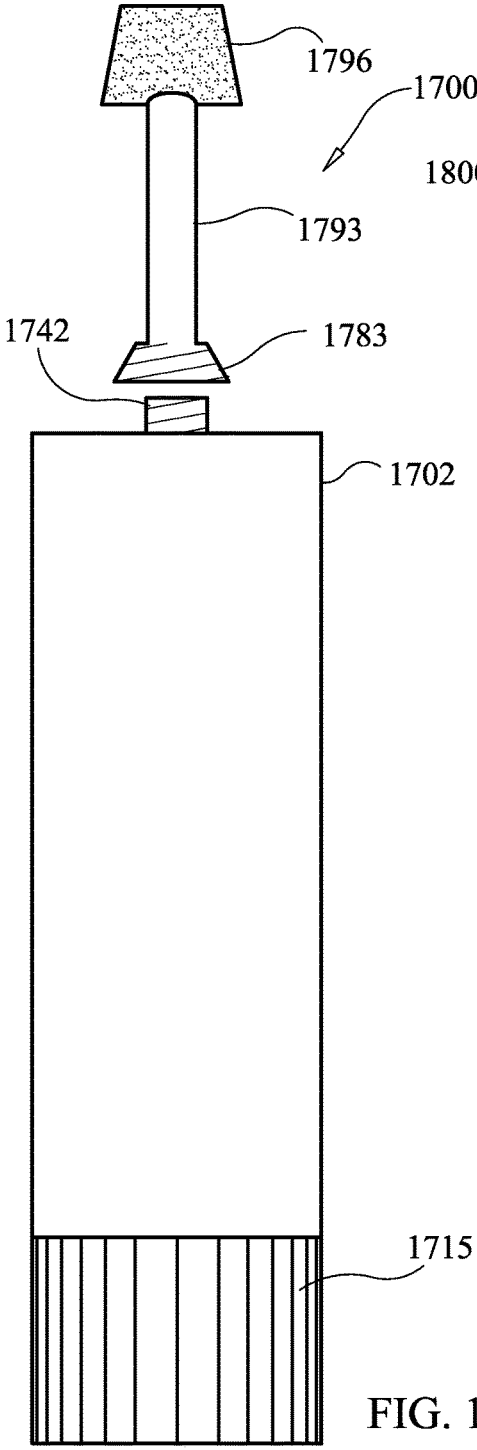
FIG. 17 is an elevation view illustrating a twist-up container/dispenser which may be used for paint.

FIG. 17 illustrates a twist-up container/dispenser 1700 that can be used to contain and dispense paint. This embodiment may be used with a bellows, with a two part bellows, or without a bellows as described herein. Paint is contained within container body 1702. An applicator 1793 has an applicator coupling means 1783, which is in one embodiment a threaded coupling. Container 1702 has a container coupling means 1742, which in one embodiment is a threaded coupling. Applicator coupling means 1783 and container coupling means 1742 could be any known in the art including, for example, a bayonet lock. A surface applicator 1796, such as a sponge applicator, is affixed to mixing applicator 1793, which permits paint to mix before distribution onto sponge applicator 1796.

Figure 18:
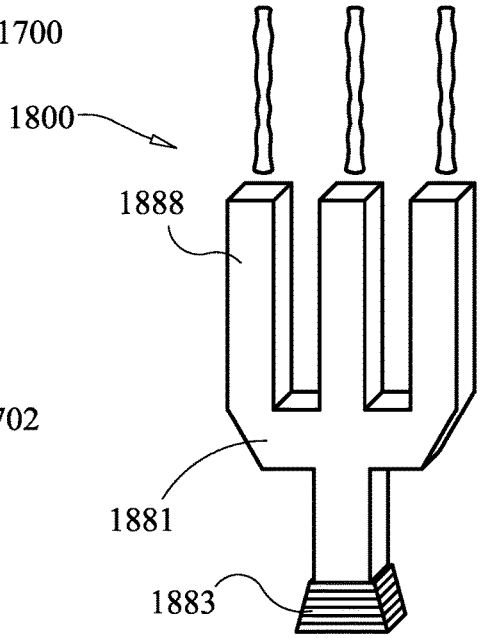
FIG. 18 is a perspective view illustrating a 3-way applicator.

FIGS. 18-23 illustrate a variety of applicators. FIG. 18 and illustrates an alternative embodiment applicator. FIG. 18 illustrates a 3-in-1 applicator 1800. Applicator 1800 has a coupling means 1883, a mixing manifold area 1881 individual applicator tips 1888. The 3-in-1 applicator 1800 could be a three-in-one mastic or caulking tip capable of dispensing three beads of product in a single pass.

Figure 19:
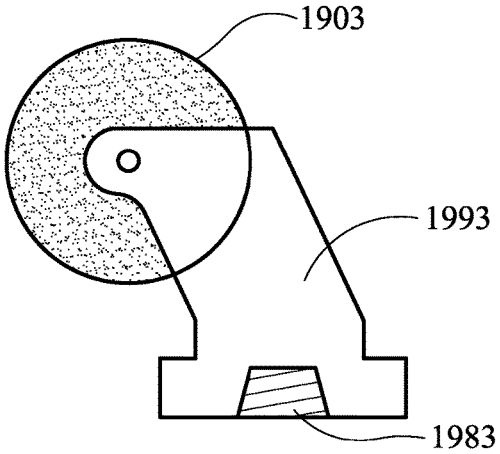
FIG. 19 is an elevation view illustrating a roller applicator.

FIG. 19 illustrates a roller applicator having a coupling means 1983. Roller applicator includes a mixing applicator 1993 having at least open opening to deposit material on roller sponge 1903 for application to a surface.

Figure 20:
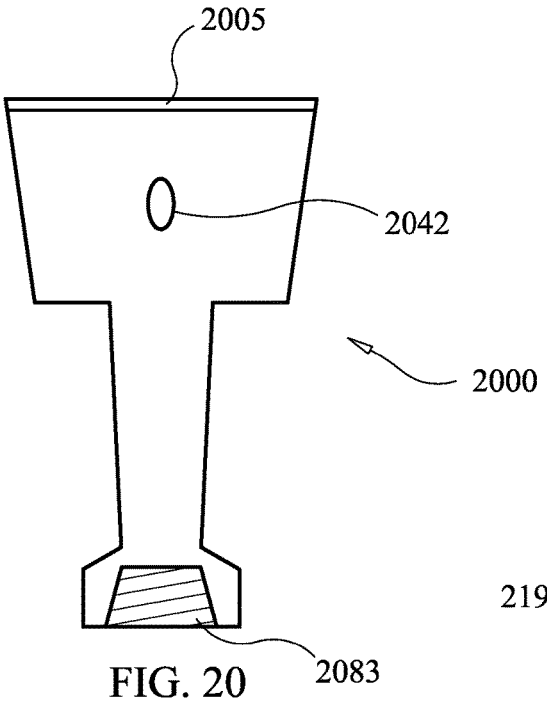
FIG. 20 is an elevation view illustrating a knife applicator having a blade surface.

FIG. 20 illustrates a knife applicator 2000 having a blade surface 2005 area. Applicator 2000 is affixed to a container body via attachment means 2083. Applicator 2000 has product egress point 2042 from which product flows.

Figure 21:
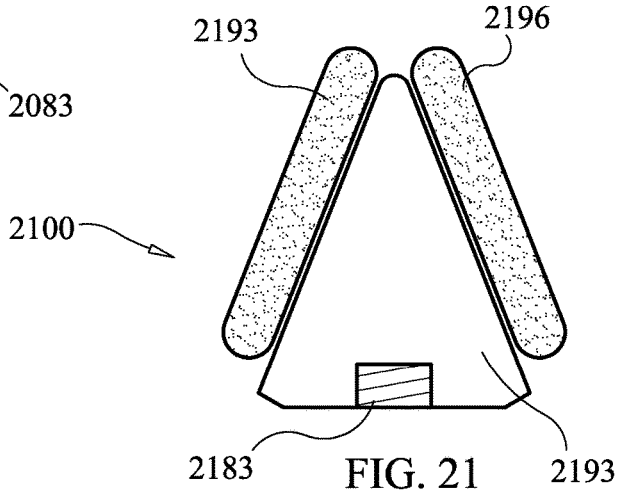
FIG. 21 is an elevation view of a dual-sponge applicator.
Figure 22:
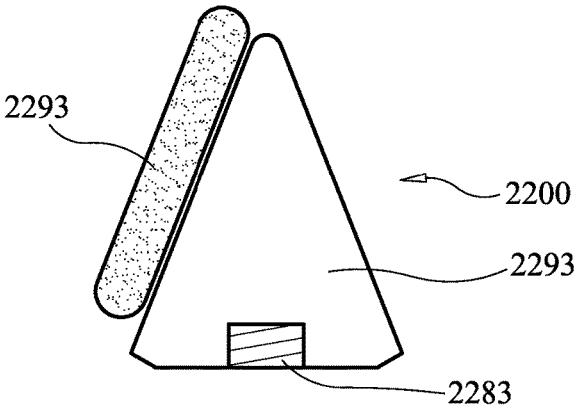
FIG. 22 is an elevation view of a single sponge applicator.

FIG. 21 illustrates an applicator 2100 having a mixing chamber 2193, an attachment means 2183 and a first applicator sponge 2193 and a second applicator sponge 2196. FIG. 22 illustrates an applicator 2200 having a mixing chamber 2293, an attachment means 2283, and a single applicator sponge 2293.

Figure 23:
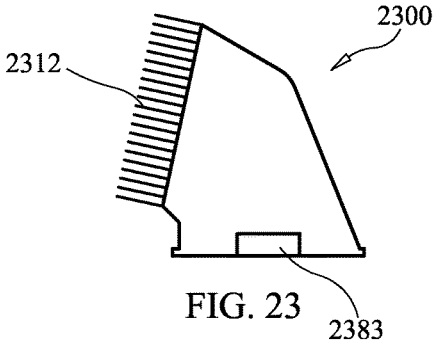
FIG. 23 is an elevation view of a brush applicator.

FIG. 23 illustrates brush applicator 2300 utilizing brush 2312, and attachment means 2383, which may be used to apply any material where brush 2312 facilitates dispensing product.

Figure 24:
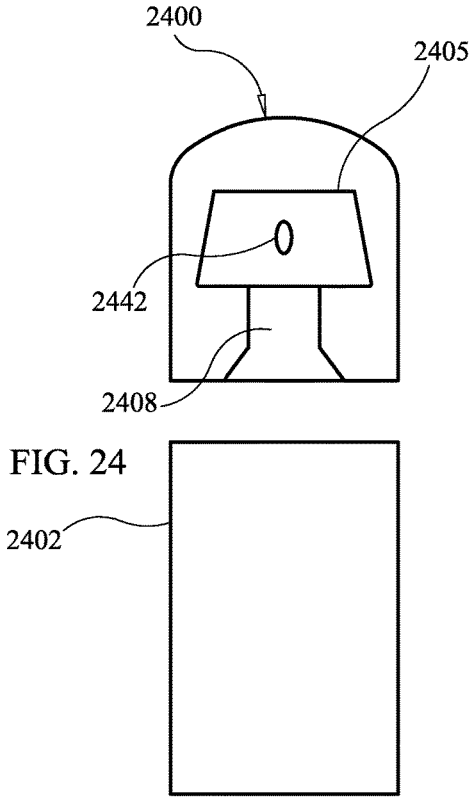
FIG. 24 is a partially exploded elevation view illustrating an applicator having a clear plastic dome.

FIG. 24 illustrates an applicator having a clear plastic dome 2405. Product flows from outflow area 2408 to product egress point 2442. A relatively sharp edge 2405 aids in product distribution. Applicator 2400 may be snap-fit onto base 2402.

Figure 25:
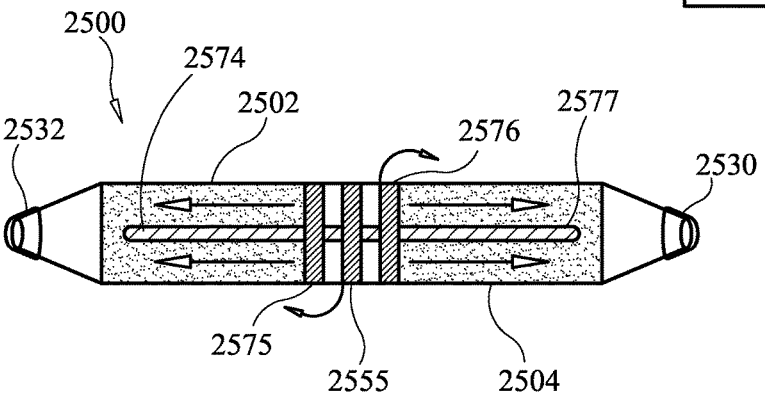
FIG. 25 is an elevation view of a two-in-one applicator having a first container body and second container body.

FIG. 25 is a two-in-one applicator 2500 having a first container body 2502 and second container body 2504. First container body 2502 and second container body 2504 are connected by an adjoining member 2555. A user desiring products in the second container body 2504 may hold first container body 2502 stationary and rotate second container body 2504 to advance second platform 2576 axially on second rod 2577 in the direction of second container tip 2530. A user, desiring products in first container body 2502 may hold second container body 2504 stationary and rotate first container body 2502 to move platform 2575 in the direction of first container tip 2532 A dispenser for flowable materials, comprising: a first end container body having a first end threaded rod disposed within said container body, a first end platform having a threaded aperture, wherein said first end platform threadably engages said threaded rod, wherein said first end platform is disposed on said first end rod, wherein said first end container body is shaped to define a first end container tip; a second end container body having a second end threaded rod disposed within said container body, a second end platform having a threaded aperture, wherein said second end platform threadably engages said threaded rod, wherein said second end platform is disposed on said second end rod, wherein said second end container body is shaped to define a second end container tip; an adjoining member affixed to first rod and second rod, wherein a user, desiring products in first container body holds second container body stationary and rotates first container body to move first platform in the direction of first container tip, wherein a user, desiring products in second container body holds first container body stationary and rotates second container body to move second platform in the direction of second container tip.

Figure 26:
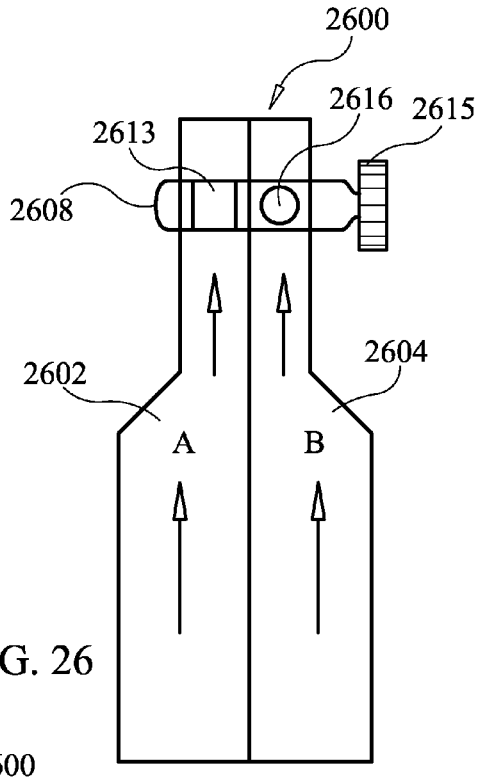
FIG. 26 is an elevation view of a two-part container/dispenser 2600 divided into two separate compartments.

FIG. 26 is a two-part container/dispenser 2600 divided into two separate compartments, a first compartment 2602 and a second compartment 2604, having a turnable knob 2608 with a handle 2615 to open a single side at one time. A first cylindrical channel 2613 in knob 2608 permits flow in first compartment 2602 when rotated such that channel 2613 is substantially vertical (as shown). A second cylindrical channel 2616 is offset by 90 degrees—and is oriented horizontally (as shown), when said second channel 2616 is oriented horizontally second compartment 2604 is sealed, until knob 2615 is rotated such that channel 2616 is oriented vertically, and compartment 2604 is open.

Figure 27:
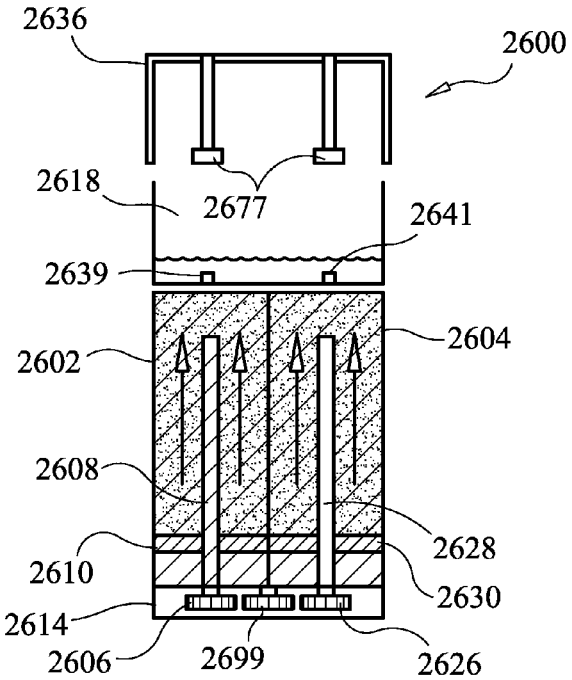
FIG. 27 is a schematic shows a twist-up dual applicator dispenser.
Figure 28:
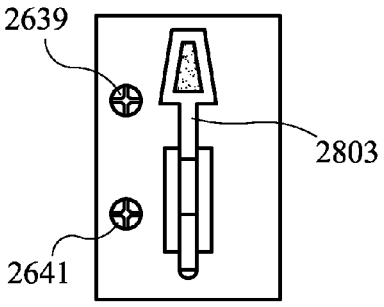
FIG. 28 is a top view of FIG. 27.

FIG. 27 shows a twist-up dual applicator dispenser 2600 having a first container body 2602 and second container body 2604, both with independent compartments. First gear 2606 is coupled to first rod 2608 to drive first disc 2610. Product moves from first container body 2602 through first valve 2639 into mixing bowl 2818. Second gear 2626 is coupled to second rod 2628 to drive second disc 2630. Product moves from second container body 2604 through second valve 2641 into mixing bowl 2618. Central gear 2699 is affixed to rotatable handle 2614 and are in meshing engagement with first gear 2606 and second gear 2626. When handle 2614 and central gear 2699 rotate, first gear 2606 and second gear 2626 rotate and drive rod first rod 2608 and second rod 2628 respectively, which in turn advance first disc 2610 and second disc 2630 respectively, axially. FIG. 28 illustrates a top view of apparatus top showing first valve 2639 and second valve 2641, and mixing applicator 2803. Products from first container body 2602 and second container body 2604 can be manually mixed further by the user in mixing bowl 2818 until ready for application. Mixing pins 2677, mounted within cover 2636, keep material inside containers and not leaking through first valve 2639 and second valve 2641 before intended use.

Figure 29:
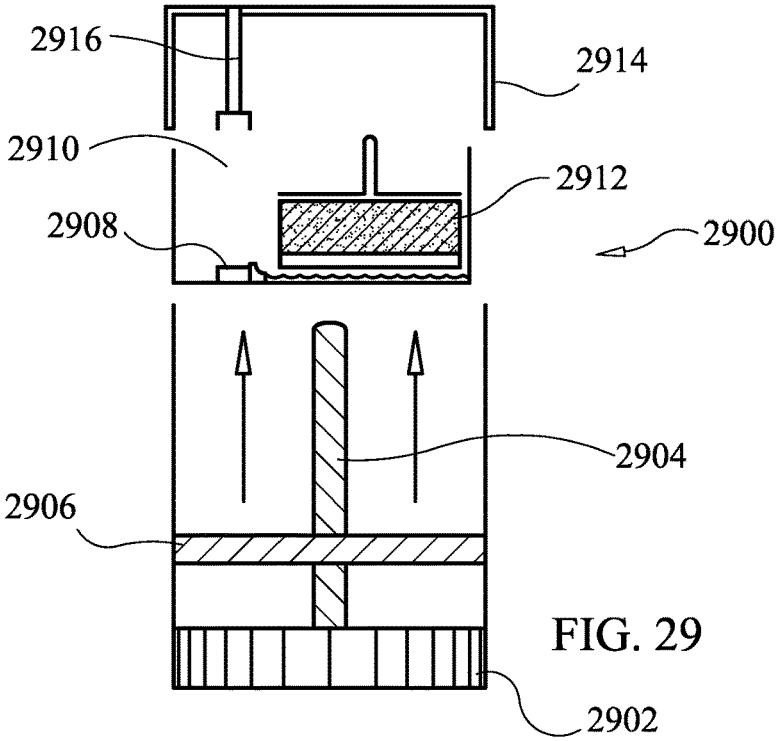
FIG. 29 is a schematic view shows a container/dispenser.

FIG. 29 shows a container/dispenser 2900 having a handle 2902 affixed to rod 2904. Platform 2906 is disposed on rod 2904. As platform 2906 is driven upwardly, product is expressed from product egress point 2908 into mixing bowl 2910. Sponge applicator 2912 may be used to collect product in mixing bowl for application to a surface. Cover 2914 fits over bowl 2910. Pin 2916 is affixed to cover 2914 with the terminal aspect of pin 2916 covering egress point 2908 when cover 2914 is affixed to bowl 2910. Bowl 2910 is washable.

Figure 30:
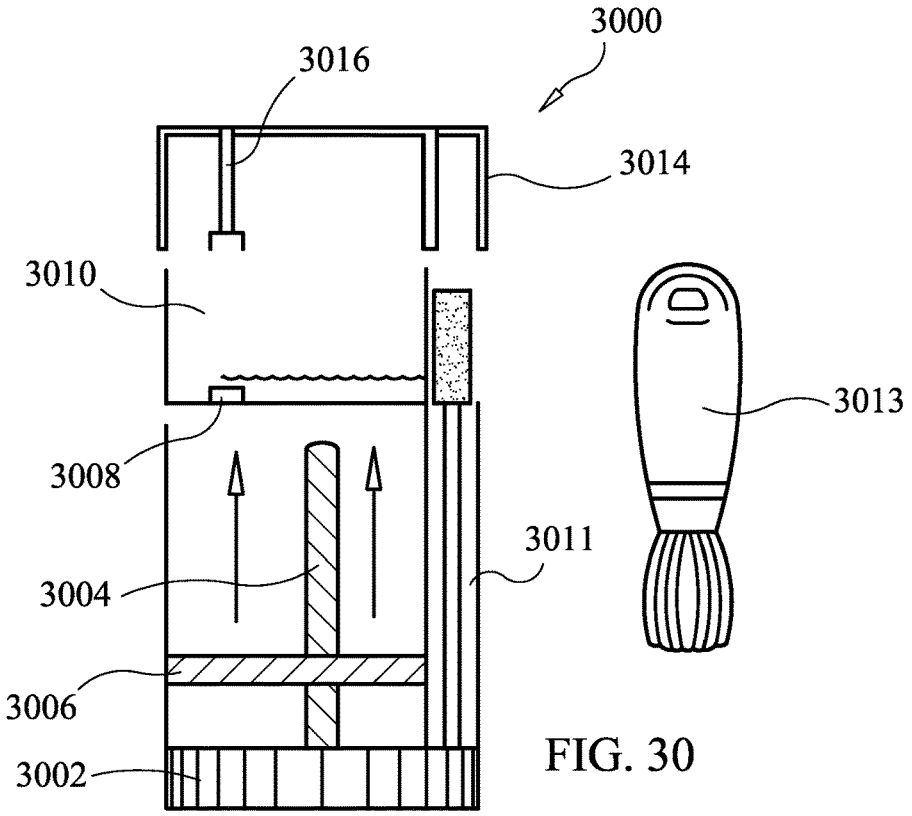
FIG. 30 is a schematic view shows a container/dispenser.

FIG. 30 shows a container/dispenser 3000 having a handle 3002 affixed to rod 3004. Platform 3006 is disposed on rod 3004. As platform 3006 is driven upwardly, product is expressed from product egress point 3008 into mixing bowl 3010. Applicator 3013 is disposed in a side compartment 3011 of dispenser 3000, may be used to collect product in mixing bowl for application to a surface. Cover 3014 fits over bowl 3010. Pin 3016 is affixed to cover 3014 with the terminal aspect of pin 3016 covering egress point 3008 when cover 3014 is affixed to bowl 3008. Bowl 3010 is washable. Brush 3013 may be prepackaged with container 3000. In one use, dispenser 3000 may be used as an apparatus to dispense shaving cream into mixing bowl 3010 for lathering with applicator 3012 and/or brush 3013.

Figure 31:
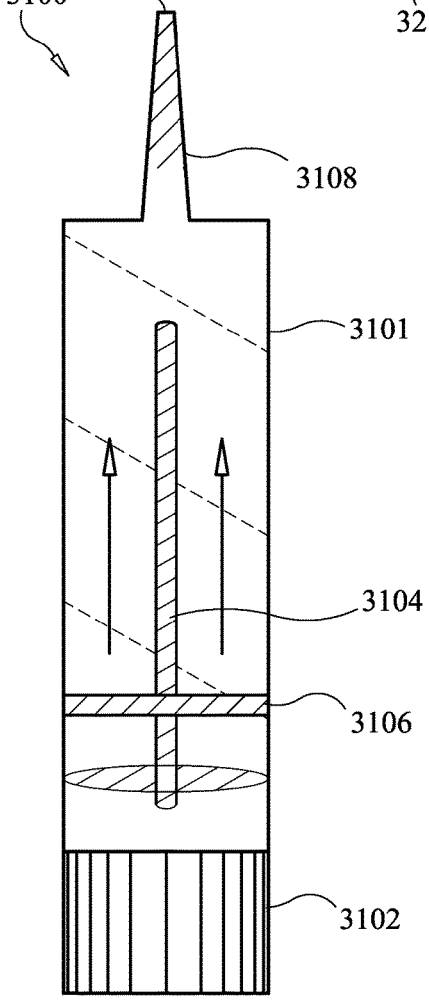
FIG. 31 is a schematic illustrating a cardboard container/dispenser having a cardboard container body

FIG. 31 illustrates a cardboard container/dispenser 3100 having a cardboard container body 3101. Handle 3102 attaches to rod 3104. Disc 3106 is disposed on rod 3104. Product may be dispensed into tip 3108 and out of opening 3110. Disc 3106 and rod 3104 may be formed of disposable plastic, urethane, metal.

Figure 32:
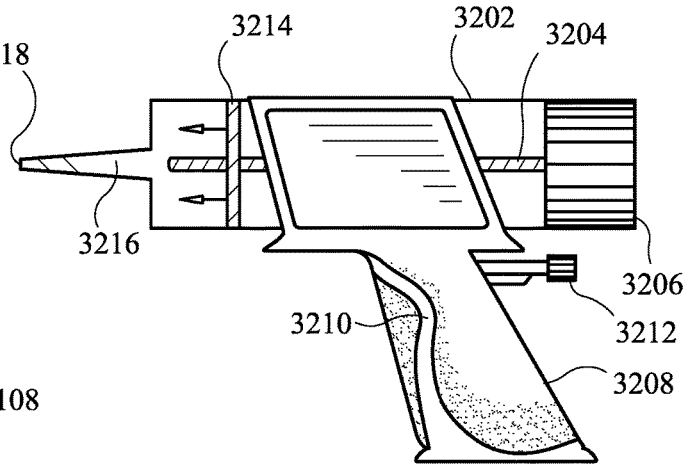
FIG. 32 is a perspective view illustrating a container/dispenser that may be hand twisted or trigger actuated.

FIG. 32 illustrates a container/dispenser 3200 that may be hand twisted or trigger actuated. Inside container body 3202 is rod 3204 affixed to handle 3206. Handgrip 3208 supports finger trigger 3210. Finger trigger 3210 drives gear 3212 which is in meshing engagement with handle 3206 (shown apart for illustrative purposes only). Threaded platform 3214 is driven forward to express material into tip 3216 and out of opening 3218.

Figure 33:
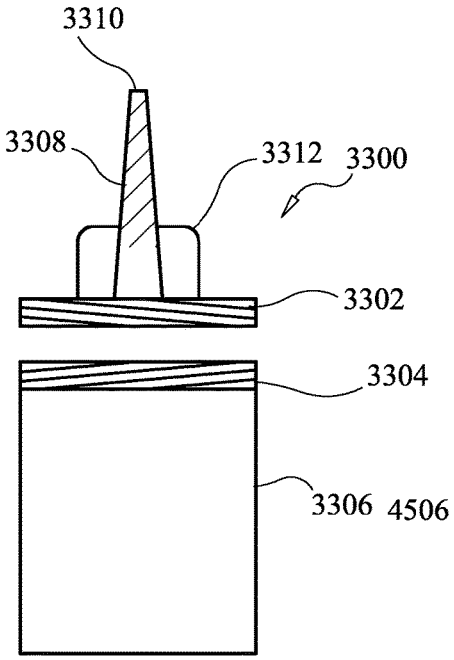
FIG. 33 is a perspective view illustrating an embodiment applicator tip having threading which mates with internal threading of container.

FIG. 33 illustrates an embodiment applicator tip 3300 having threading 3302 which mates with internal threading 3304 of container 3306. Material may flow from container body 3306 through tip 3308 and out of opening 3310. Screwing tip 3300 on container 3306 is facilitated by grip wings 3312 which provide a grasping surface and leverage to turn the applicator tip.

Figure 34:
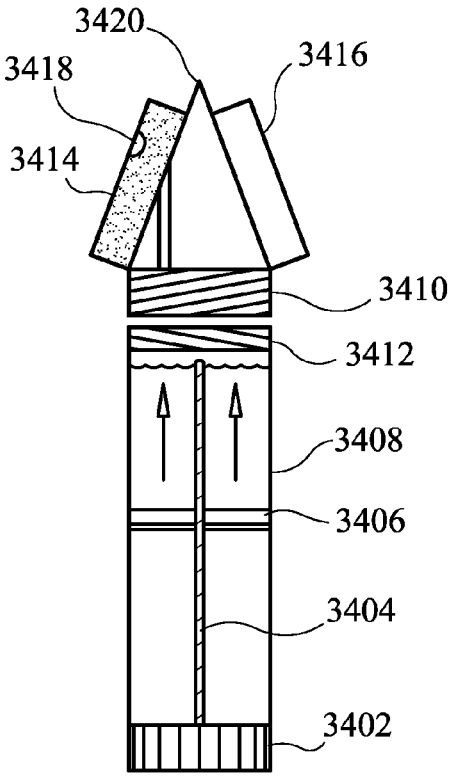
FIG. 34 is a side elevation view illustrating an embodiment twist-up container/dispenser that may be used for filling cracks and holes in walls and wood surfaces.
Figure 35:
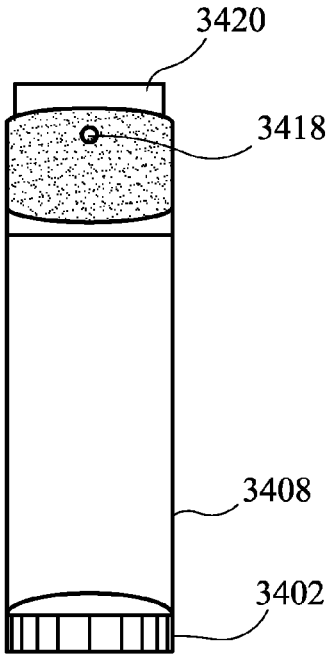
FIG. 35 is a front elevation view showing feed hole.
Figure 36:
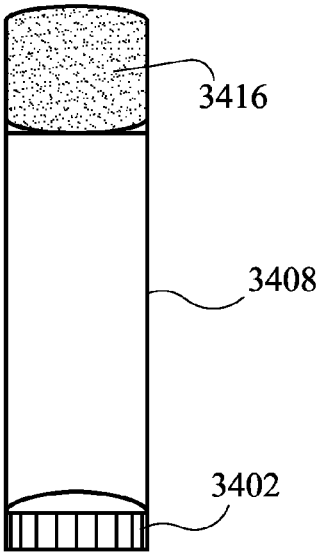
FIG. 36 is a back elevation view showing the opposite side of sponge sandpaper.
Figure 37:
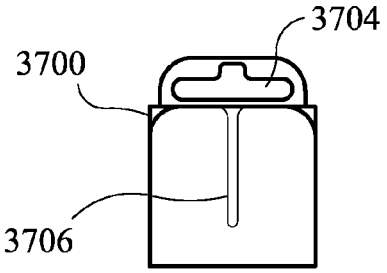
FIG. 37 is a side view illustrating an embodiment cap which may fit over both sponge applicator and sandpaper.

FIG. 34 illustrates a side view of an embodiment twist-up container/dispenser 3400 that may be used for filling cracks and holes in walls and wood surfaces. Container 3400 has handle 3402 coupled to rod 3404. Disc 3406 is threaded on rod 3404 and may move upwardly inside container body 3408. Cap 3410 may be threadably attached to threadable engagement 3412 of container body 3408. First surface has sponge applicator 3414, second surface has sand sponge sandpaper 3416. Material exits container 3408 interior through feed hole 3418. Putty knife 3420 is mounted on the top surface of container/dispenser 3400. FIG. 35 is a front view showing feed hole 3418. FIG. 36 is a back view showing the opposite side of sponge sandpaper 3416. FIG. 37 illustrates cap 3700 which may fit over both sponge applicator 3414 and sandpaper 3416. Hanging hole 3704 provides product display, contains pin 3706 to engage feed hole 3418 and maintain patency.

Figure 38:
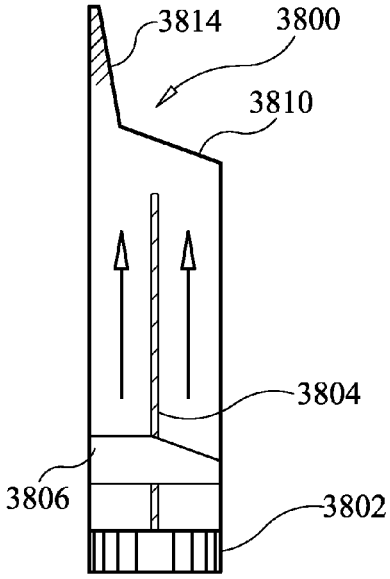
FIG. 38 is a schematic view of an offset embodiment container/dispenser.

FIG. 38 features an offset applicator embodiment 3800. Handle 3802, is affixed to rod 3804 which is threadably attached to platform 3806. Platform 3806 is shaped to match container top 3810. Product is dispensed into an offset applicator and exits through opening 3814.

Figure 39:
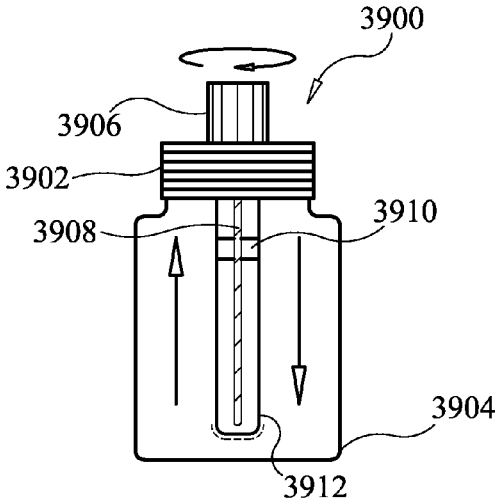
FIG. 39 is a schematic view of an embodiment dropper container/dispenser.

FIG. 39 illustrates a dropper container/dispenser 3900. Twistable cap threading 3902 may accommodate a cap. Twist handle 3906 is affixed to rod 3908. viscous materials Platform 3910 is threadably engaged on rod 3908 and sealingly engages dropper tubing 3912. On rotating handle 3906 and affixed rod 3908, platform 3910 moves upwardly in dropper tubing 3912 exerting a negative pressure drawing liquid into dropper tubing 3912. Rotating handle 3906 in the opposite direction dispenses an amount of liquid from dropper tubing 3912. Rotation of handle 3906 is more precisely controlled as compared to a typical bulb-style dropper—the result being a more precise and accurate dispenser control of flowable liquid.

Figure 40:
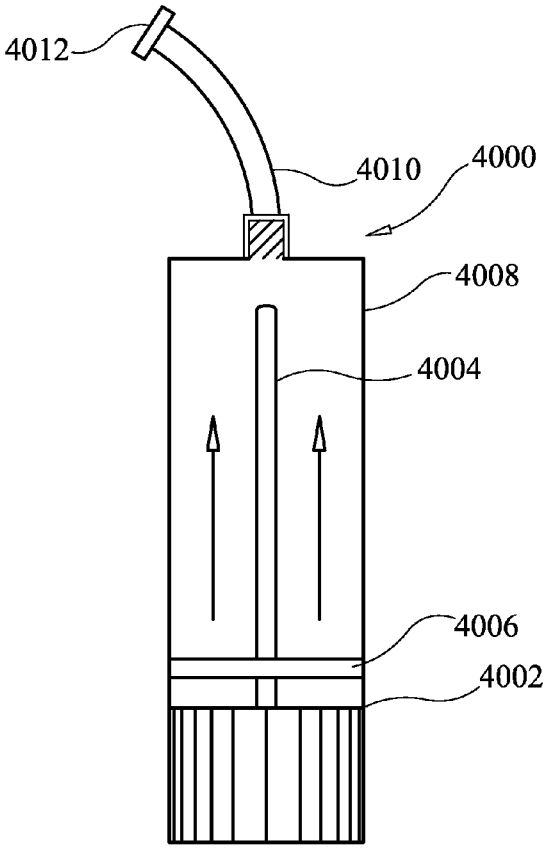
FIG. 40 is a schematic view of an embodiment container/dispenser adapted for grease.

FIG. 40 illustrates a container/dispenser 4000. Handle 4002 is affixed to rod 4004 which threadably engages platform 4006. Product in container 4008 may be expressed through hose 4010 and out snap-on connecter 4012 located at the end of hose 4010.

Figure 41:
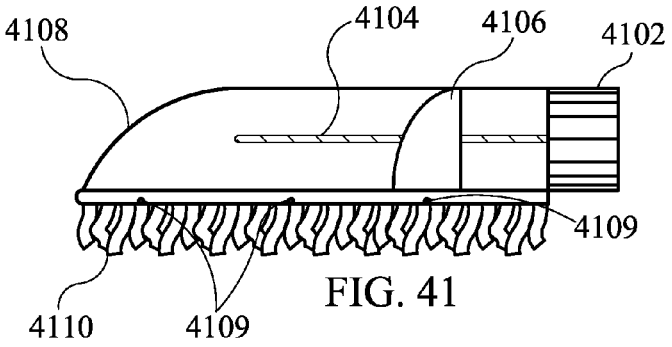
FIG. 41 is a schematic view of an embodiment container/dispenser.

FIG. 41 illustrates a container/dispenser 4100. Handle 4102 is affixed to rod 4104 which threadably engages platform 4106. Product in container 4108 may be expressed through product egress holes 4109 and collected onto applicator 4110 which may be comprised of sponge or soft cloth. This embodiment may be particularly useful as an applicator for substances in automobile detailing such as soap and wax typically utilized in auto cleaning and detailing.

Figure 42:
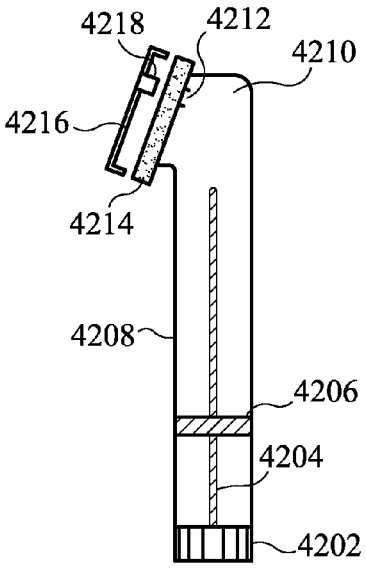
FIG. 42 is a schematic view of an embodiment container/dispenser.
Figure 43:
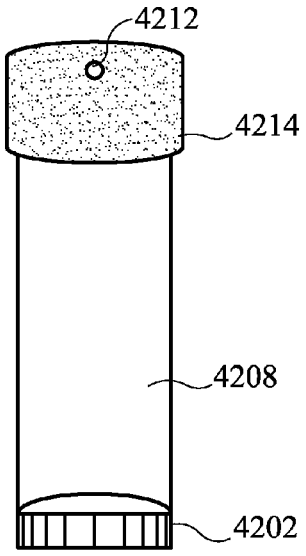
FIG. 43 is an elevation view of an embodiment container/dispenser.

FIGS. 42 and 43 illustrate a container/dispenser 4200. Handle 4202 is coupled to rod 4204 which threadably engages platform 4206. Platform 4206 drives product from the interior of container body 4208 through angle 4210 and out through egress point 4212 and onto applicator 4214. In one embodiment applicator 4214 is a sponge applicator. Cover 4216 covers applicator 4216 and bears pin 4218. Pin 4218 keeps product inside container/dispenser 4200, and not leaking from egress point 4212 before intended use.

Figure 44:
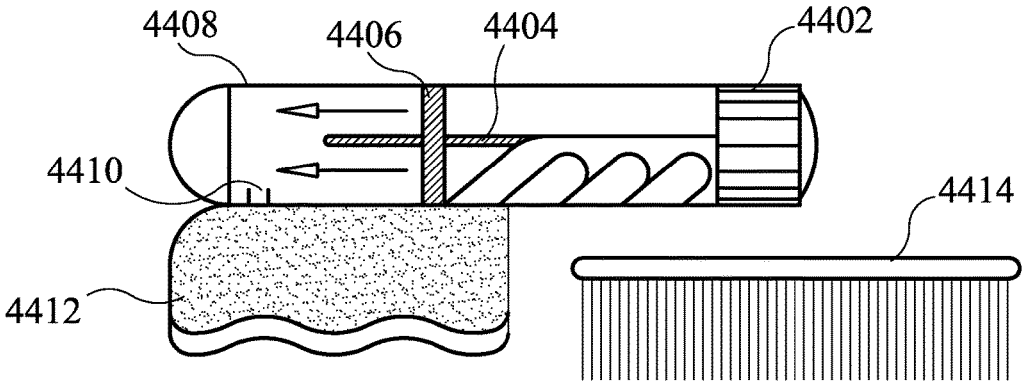
FIG. 44 is a schematic view of an embodiment container/dispenser.

FIG. 44 illustrates a container/dispenser having a handle 4402 coupled to rod 4404 which threadably engages platform 4406. Platform 4406 drives product through flow hole 4410 which collects on sponge applicator 4412. Alternatively, brush 4414 may be used to distribute product.

Figure 45:
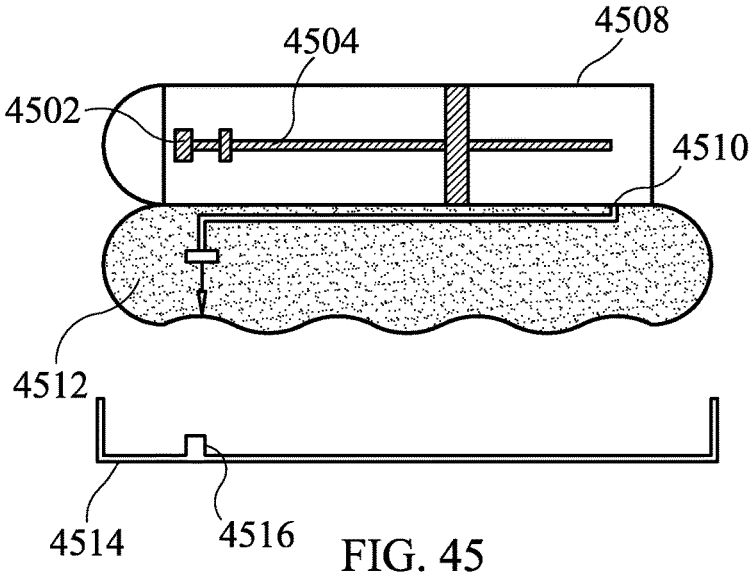
FIG. 45 is a schematic view of a button actuated container/dispenser.
Figure 46:
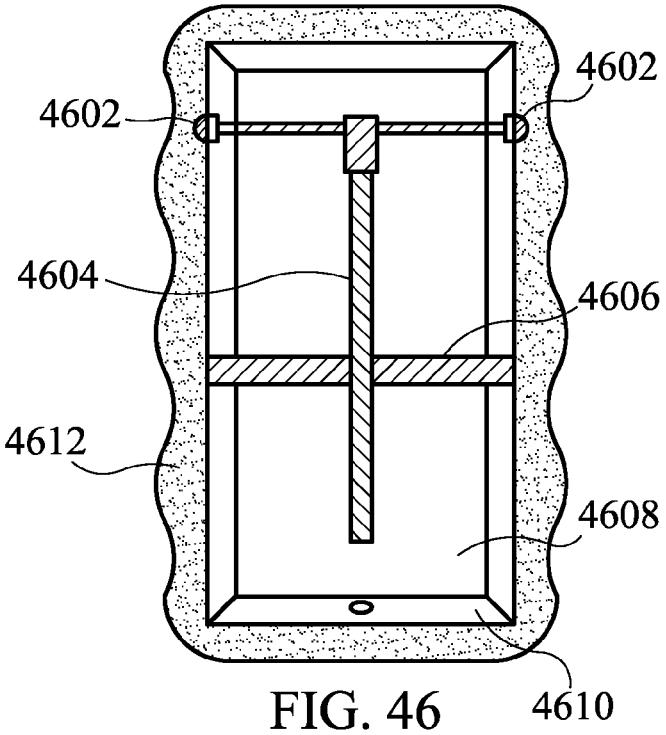
FIG. 46 is a schematic view of a button actuated container/dispenser.

FIGS. 45 and 46 illustrate an embodiment container/dispenser having buttons 4502 which actuate rod 4504 to drive platform 4506. Flowable product exits flow hole 4510 and collects on sponge applicator 4512. Applicator is covered by covering 4514 which has pin 4516.

Figure 47:
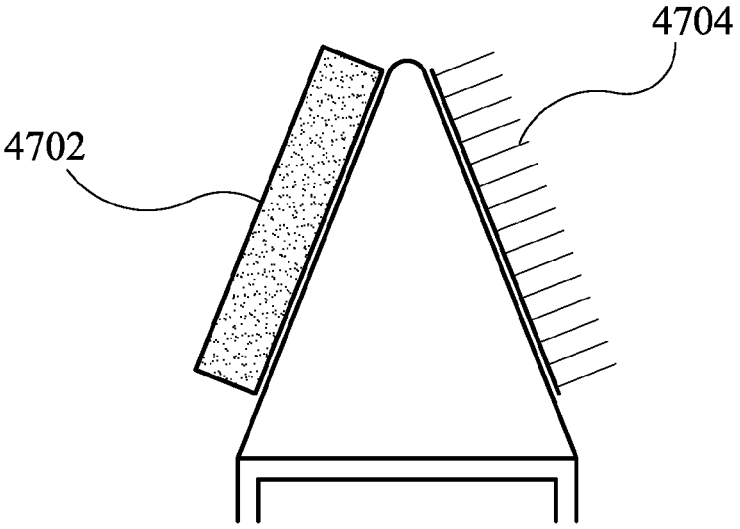
FIG. 47 is an elevation view of an embodiment applicator having a sponge applicator and brush.

FIG. 47 illustrates an embodiment applicator having a sponge applicator 4702 on one side and a brush 4704 on the other side. Applicator may be snap-fit onto container.

Figure 48:
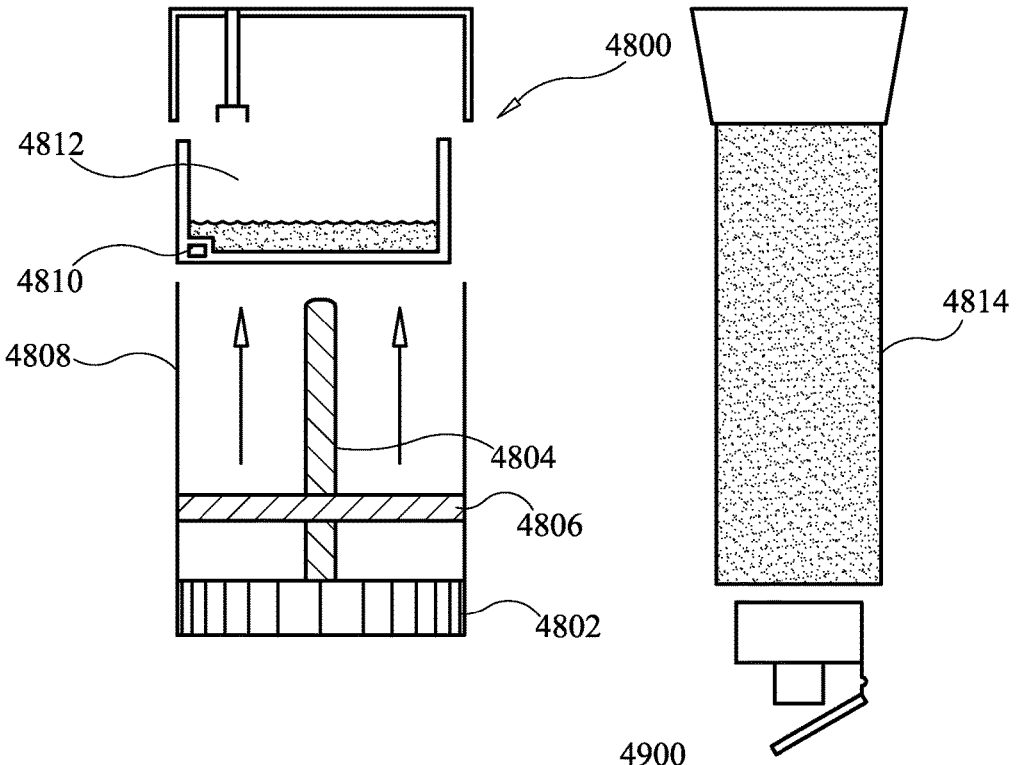
FIG. 48 is a schematic view of an embodiment container/dispenser having a mixing bowl.

FIG. 48 illustrates a container/dispenser 4800. Handle 4802 is coupled rod 4804 and threadable disc 4806. Flowable material contained within container 4808 may be driven by disc 4806 through flow hole 4810 into mixing bowl 4812. A second applicator 4814 may be used dispenses a certain volume of a second product for mixture into bowl 4812.

Figure 49:
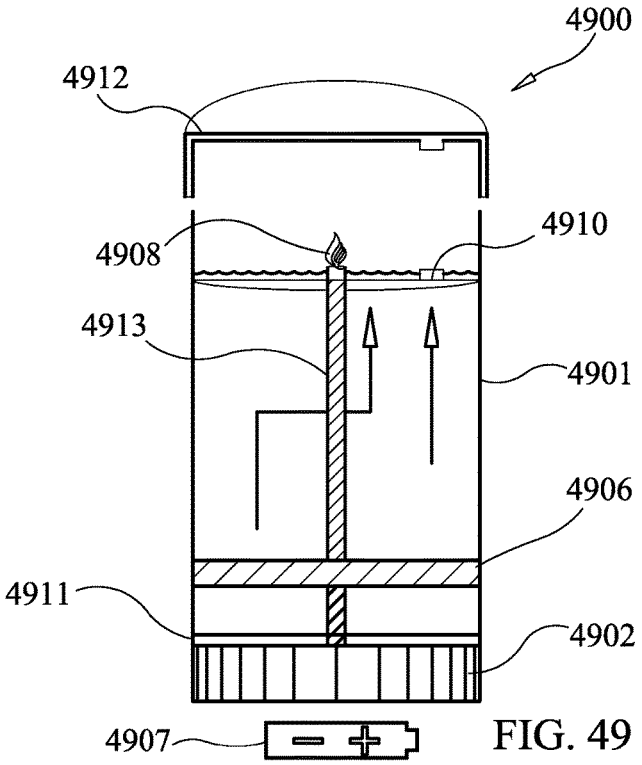
FIG. 49 is a schematic view of an embodiment container/dispenser for candles.

FIG. 49 illustrates an LED candle container/dispenser 4900. Handle 4902 is affixed to hollow rod 4913 which threadably engages platform 4906. Battery 4907 makes contact with LED light 4908 via wires 4911 which run through hollow rod 4904 and make contact between and electrically connect battery 4907 and light 4908. Scent producing liquids or semi-solids are contained within body 4901. Platform 4906 drives scented oil through flow hole 4910. Cover 4912 can diffuse light and control the scent dissipation.

Figure 50:
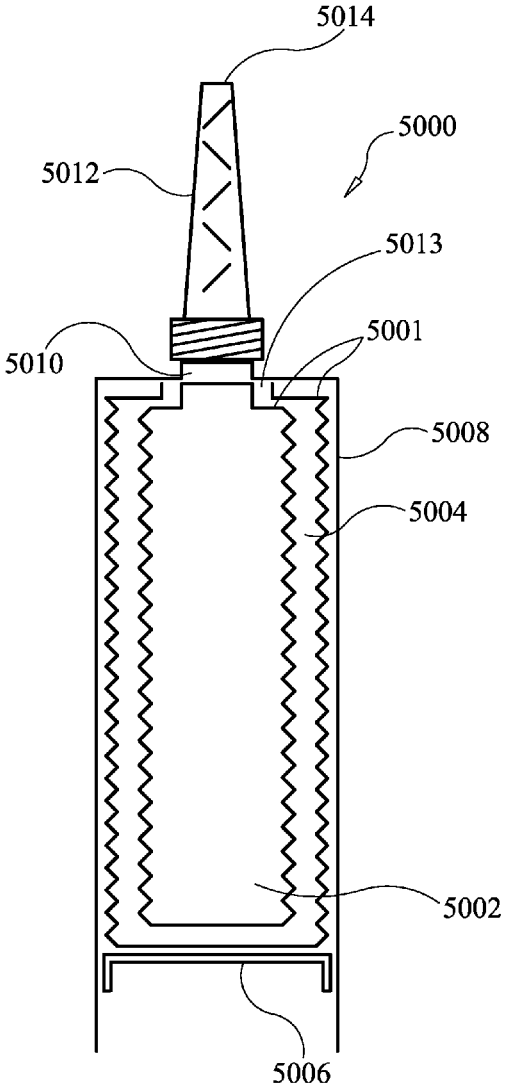
FIG. 50 is a sectional view of a multi-chambered caulking mastic container/dispenser.

FIG. 50 illustrates a caulking/mastic container 5000. A multi-chambered bellows member 5001 is disposed within said container body 5008, wherein said bellows member 5001 is shaped to define; a collapsible first bellows chamber 5002, said first bellows chamber having a first end and a second end, wherein said first bellows chamber has a volume, wherein said volume can be changed by compression, wherein first bellows chamber 5002 has an opening which defines a first chamber outflow tract 5110, wherein said multi-chambered bellows member 5001 is further shaped to define a collapsible second bellows chamber 5004, said second bellows chamber having a first end and a second end, wherein said second bellows chamber 5004 has a volume, wherein said volume can be changed by compression, wherein second bellows chamber 5004 has an opening which defines a second chamber outflow tract 5013. Platform 5006 is disposed within container 5008. Movement of platform 5006 in the axial direction toward tip 5012 with sufficient force compresses first bellows 5002 and second bellows 5004 to force materials through outflow tracts 5010 and 5013 into mixing tip 5012 and out opening 5014.

Figure 51:
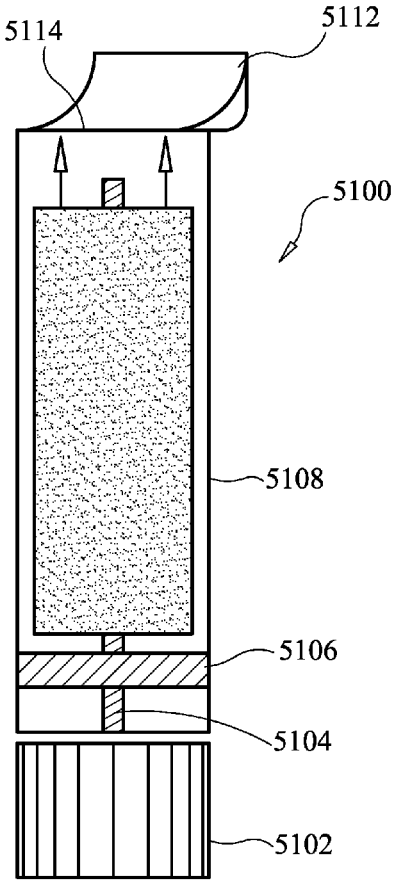
FIG. 51 is a schematic view of a twist-up epoxy putty stick having a cutter top.

FIG. 51 illustrates a twist-up epoxy putty stick having a cutter top. Handle 5102 is affixed to rod 5104 coupled to platform 5106 to drive material from inside container body 5108 through egress point 5114. Cutting top 5112 can be used to push and cut epoxy as it cures.

Figure 52:
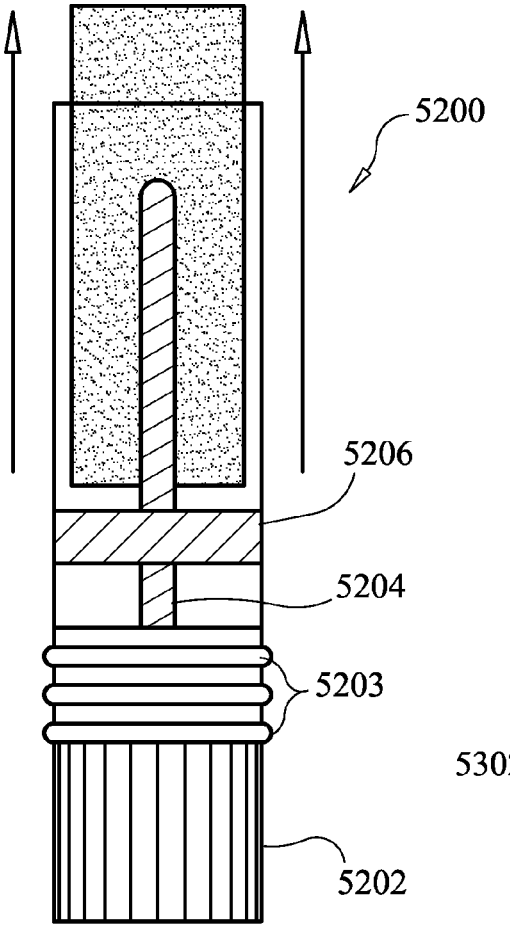
FIG. 52 is a schematic view of a container/dispenser for twist-up ice pops.
Figure 53:
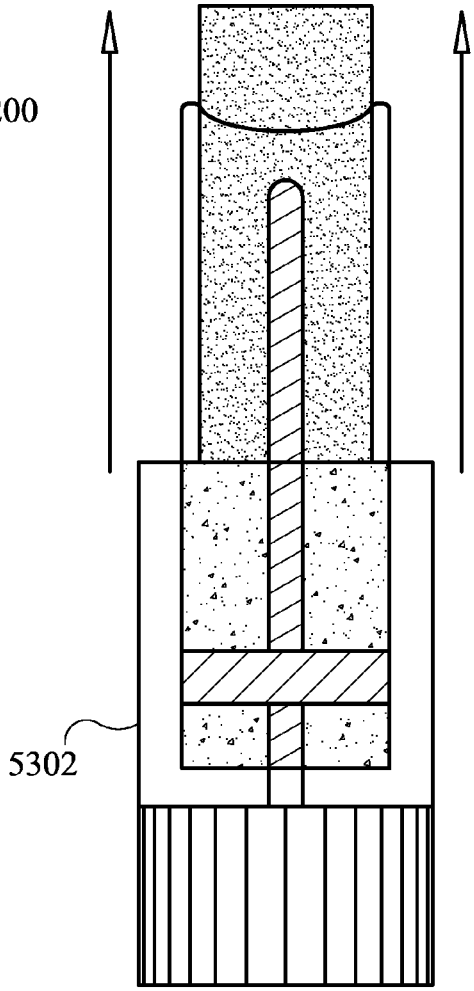
FIG. 53 is a schematic view of container/dispenser for twist-up ice pops showing holder tray.
Figure 54:
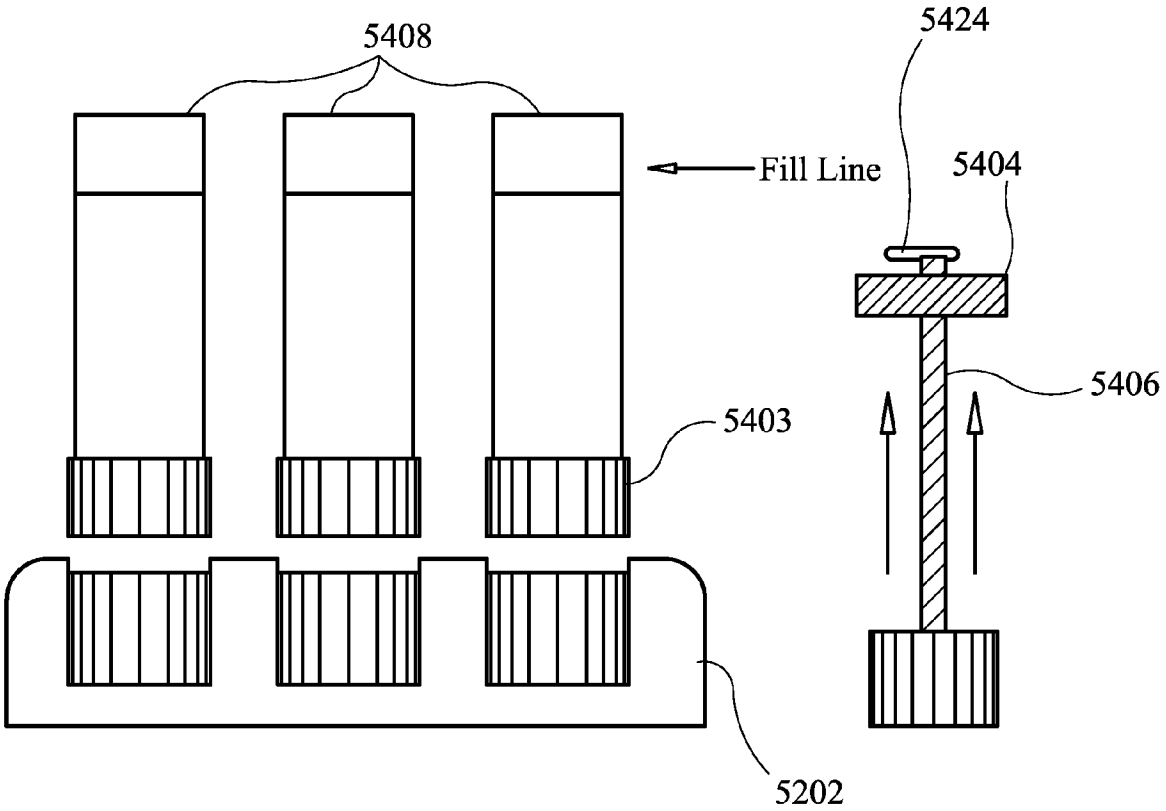
FIG. 54 is an elevation view showing a holding tray for a plurality of container/dispensers.

FIGS. 52-54 illustrates a container/dispenser 5200 for twist-up ice pops and the like. Handle 5202 has holding rings 5203 which prevent thermal transfer from hands—and keep hands from getting cold. Handle 5202 is affixed to rod 5204 and disc 5206. Rotating handle 5202 rotates affixed rod 5204 and drives disc 5206 upwardly. FIG. 53 illustrates holding tray 5302 having a shape that registers with handle 5202 for holding containers 5308.

FIG. 54 shows holding tray 5402 for holding a plurality of container/dispensers. Rotating handle 5403 is shaped to register with tray 5402 to hold numerous containers 5408. A platform stop 5424 prevents platform 5404 from being advanced off of rod 5406. Freezable treats may be created by filling containers 5408 to a fill line and exposing them to freezing temperatures.

Figure 55:
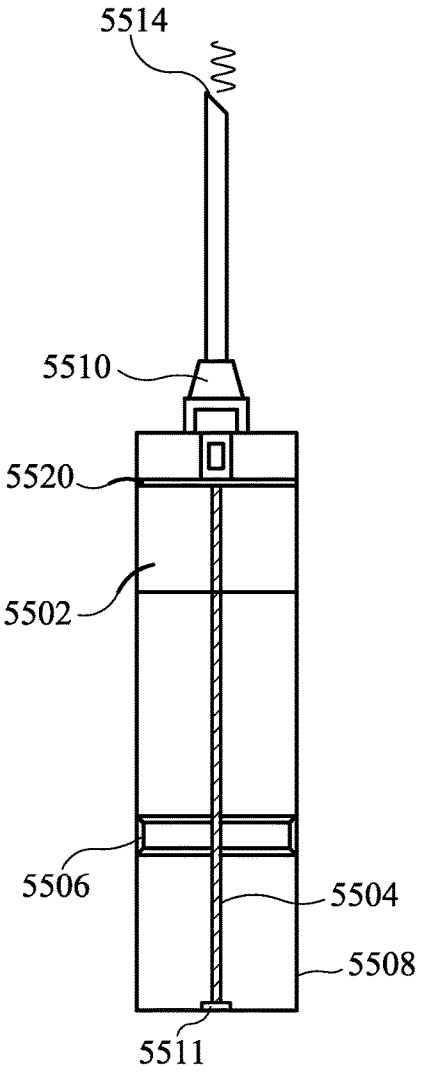
FIG. 55 is a schematic view of a syringe having a rotatable handle.
Figure 56:
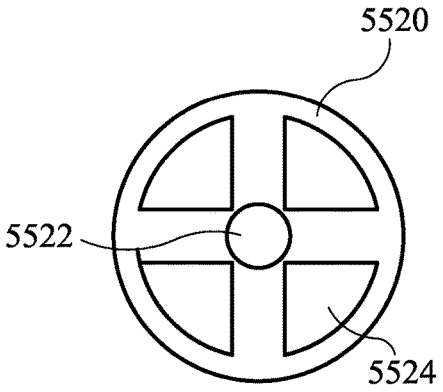
FIG. 56 is a top view of an embodiment handle taken through line 56-56 of FIG. 55.
Figure 57:
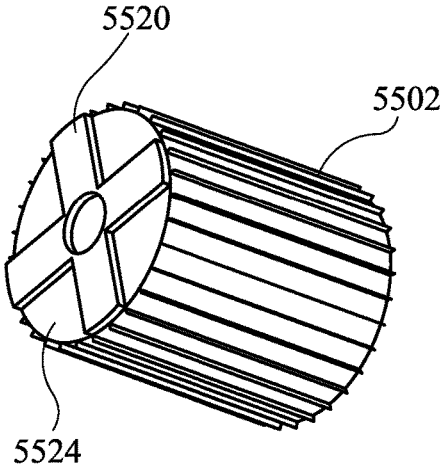
FIG. 57 is a perspective view of an embodiment handle.

FIG. 55 discloses a syringe having a rotatable handle 5502 coupled to rod 5504 and plunger 5506 which is sealingly engaged with the inner walls of container body 5508. Rod 5504 is rotatably affixed to container body 5508 bottom at rotational anchor point 5511, wherein rod 5504 is freely rotatable within. Handle 5502 top is shaped to define mounting wheel 5520. Best illustrated by FIGS. 56 and 57, mounting wheel 5520 and has central rod mount 5522 which is affixed to rod 5504 such that handle 5502 and rod 5504 rotate together. Mounting wheel 5520 is shaped to define flow openings 5524 permitting flowable materials compressed by plunger 5506 to be expressed through flow openings 5524 then through egress point 5510 through needle 5514.

Figure 58:
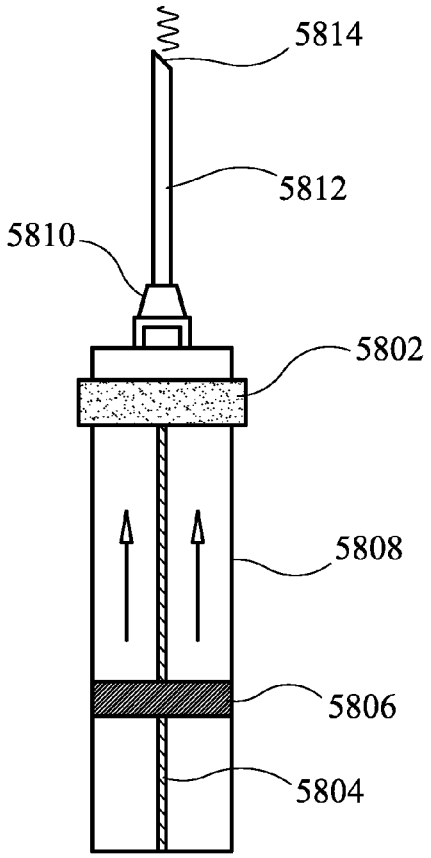
FIG. 58 is a schematic view of a syringe having a rotatable narrow handle.

FIG. 58 discloses a syringe having a rotatable narrow handle 5802 coupled to rod 5804 and plunger 5806 which is sealingly engaged with the inner walls of container body 5808. Materials may be expressed through egress point 5810 through needle 5812 and out opening 5814.

Figure 59:
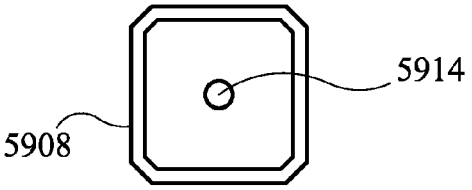
FIG. 59 is a top view of an embodiment cubodially shaped syringe.

FIG. 59 illustrates embodiment top view of an embodiment cuboidal container body 5908 showing needle 5912.

Figure 60:
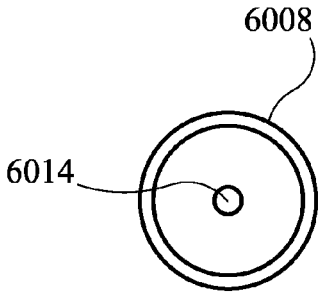
FIG. 60 is a top view of an embodiment cylindrically shaped syringe.

FIG. 60 illustrates embodiment top view of an embodiment cylindrical container body 6008 showing needle 6014.

Figure 61:
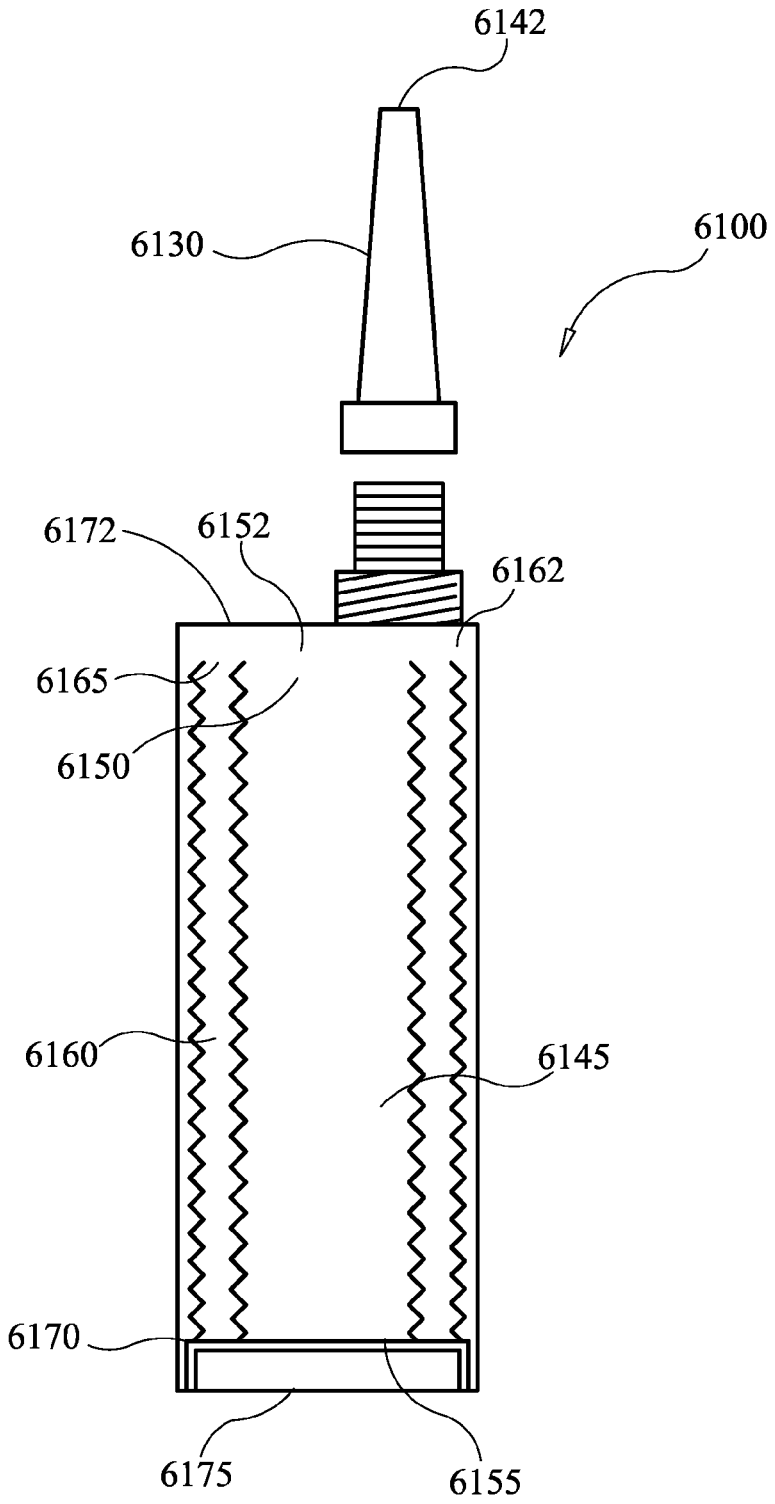
FIG. 61 is a schematic view illustrating an embodiment retrofit apparatus for existing caulking containers

FIG. 61 illustrates an embodiment retrofit apparatus for existing caulking containers. Turning now to the drawings, FIG. 61, container/dispenser 6100 cylindrical container body 6110 having a first end and second end, wherein the container body 6110 has a diameter and diametrical void, wherein said cylindrical container 6110 has a long axis.

A collapsible bellows member shaped to define a first bellows chamber 6145, disposed within the cylindrical container body 6110, said first bellows 6145 having a first end 6150 and a second end 6155, wherein said bellows has a volume, wherein said volume can be changed by compression, wherein at least a portion of said bellows first end 6150 is open defining a first bellows container outflow tract 6152. The collapsible bellows member is shaped to define a collapsible second bellows chamber 6160, disposed within the cylindrical container body 6110, said second bellows 6160 having a first end 6165 and a second end 6170, wherein said bellows 6160 has a volume, wherein said volume can be changed by compression, wherein a portion of said second bellows 6160 first end 6165 is open defining a second bellows container egress point 6162.

A platform 6175 having a diameter, wherein the diameter of platform 6175 is less than the cylindrical container's 6110 diameter.

A top cap 6172 capable of being coupled to a standard commercially available caulking tube. Top cap 6172 may be threadably coupled, snap-fit, bayonet fit, or other coupling means recognized in the art. A mixing top 6174 is affixed to top cap 6172. Mixing top 6174 is in communication with first bellows container egress point 6152 and second bellows container egress point 6162, such that flowable materials from first bellows container 6145 and second bellows container 6160 enter mixing top 6174. Flowable materials then pass into tip applicator 6130 and out opening 6142.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, which are not specified within the detailed written description or illustrations contained herein yet, are considered apparent or obvious to one skilled in the art are within the scope of the present invention. Further, it should be noted that several inventive embodiments are disclosed together for convenience; unless specified otherwise, all embodiment inventive options disclosed herein may be used independently or together with any other embodiment.

Use of distinct reference characters is for illustrative purposes only, and the illustrated embodiment or feature may be used either cooperatively with or distinctly from any other embodiment or feature unless specified otherwise.

We claim:

1. A dispenser for flowable material comprising: a container body having a first end and a second end, wherein the container body has a cross-sectional area and cross-sectional void, wherein said container has a long axis and a short axis;

a collapsible first bellows container, wherein said first bellows container has a first end and a second end, wherein said first bellows container has a volume, wherein said volume can be changed by compression, wherein first bellows container is shaped to define a first bellows aperture in the first bellows container;

a collapsible second bellows container said second bellows having a first end and a second end, wherein said second bellows has a volume, wherein said volume can be changed by compression, wherein second bellows container is shaped to define a second bellows aperture in the second bellows container, wherein the first bellows container is disposed within the second bellows container;

a disc shaped to define a central aperture, wherein the central aperture is threaded, wherein said disc has a diameter, wherein the diameter of the disc is less than the cylindrical container's diameter;

a threaded rod having a first end and second end, wherein threaded rod is disposed within said container body and passess through first bellows aperture and second bellows aperture;

a twistable handle affixed to threaded rod's second end;

wherein a user rotates said twistable handle which drives disc upwardly toward container's first end, in the direction of container's long axis, wherein as disc moves upwardly, first bellows container and second bellows container are compressed, wherein flowable materials contained within container are expressed out.

2. The dispenser of claim 1, further comprising an applicator tip affixed to said container body, said tip having an opening.

3. The dispenser of claim 1, wherein said container body is shaped to define a tip, said tip having an opening.

4. The dispenser of claim 2, wherein said affixed tip has a divider, wherein flowable material from first bellows container and second bellows container are prevented from making contact.

5. The dispenser of claim 3, wherein said tip has a divider, wherein flowable material from first bellows container and second bellows container are prevented from making contact.

6. The dispenser of claim 1, further comprising an applicator.

7. The dispenser of claim 6, wherein said applicator is a roller applicator.

8. The dispenser of claim 6, wherein said applicator is a 3-in-1 applicator.

9. The dispenser of claim 6, wherein said applicator is a blade surface.

10. The dispenser of claim 6, wherein said applicator is a sponge.

11. The dispenser of claim 6, wherein said applicator is a brush.

* * * * *